US006575447B2

(12) United States Patent
Yoshie et al.

(10) Patent No.: US 6,575,447 B2
(45) Date of Patent: Jun. 10, 2003

(54) SHEET CUTTING DEVICE AND IMAGE FORMING APPARATUS EQUIPPED THEREWITH

(75) Inventors: Kohji Yoshie, Hachioji (JP); Masato Hattori, Hachioji (JP); Shinji Yashiro, Hachioji (JP); Hirohiko Okabe, Tokorozawa (JP); Hirotaka Kataoka, Kawaguchi (JP); Makoto Tamura, Urawa (JP); Tadahiro Takahashi, Hoya (JP)

(73) Assignee: Konica Corporation (JP)

( * ) Notice: Subject to any disclaimer, the term of this patent is extended or adjusted under 35 U.S.C. 154(b) by 21 days.

(21) Appl. No.: 09/794,920

(22) Filed: Feb. 27, 2001

(65) Prior Publication Data

US 2001/0019191 A1 Sep. 6, 2001

(30) Foreign Application Priority Data

| | | |
|---|---|---|
| Feb. 29, 2000 | (JP) | 053558/2000 |
| Mar. 1, 2000 | (JP) | 055637/2000 |
| Mar. 16, 2000 | (JP) | 074049/2000 |

(51) Int. Cl.[7] ..... B42C 1/00

(52) U.S. Cl. ..... 270/58.07; 270/52.17; 270/45; 83/934; 412/16; 493/356

(58) Field of Search ..... 270/52.17, 58.07, 270/45; 412/16; 493/356, 357; 271/185, 208, 214, 216, 149; 83/937

(56) References Cited

U.S. PATENT DOCUMENTS

| | | | | |
|---|---|---|---|---|
| 1,786,752 A | * | 12/1930 | Hitchcock | 271/185 |
| 3,591,171 A | * | 7/1971 | Schmidt | 271/185 |
| 4,245,833 A | * | 1/1981 | Akerstrom | 271/177 |
| 5,100,116 A | * | 3/1992 | Graushar | 270/1.02 |
| 5,377,965 A | * | 1/1995 | Mandel et al. | 270/37 |
| 5,409,207 A | * | 4/1995 | Freeman | 271/181 |
| 5,533,719 A | | 7/1996 | Crowley et al. | |
| 6,048,152 A | * | 4/2000 | Koyama | 412/16 |

FOREIGN PATENT DOCUMENTS

| | | |
|---|---|---|
| EP | 0380259 | 1/1990 |
| EP | 0609686 | 10/1994 |

OTHER PUBLICATIONS

European Search Report EP 01 30 1745.

* cited by examiner

*Primary Examiner*—Patrick H. Mackey
(74) *Attorney, Agent, or Firm*—Muserlian, Lucas and Mercanti

(57) ABSTRACT

A sheet cutter for finishing a booklet by cutting, with a cutter, edges of a bundle of sheets folded double, wherein it is possible to load booklets on a booklet stand of a booklet storing section that stores a plurality of booklets which have been subjected to cutting processing, by overlapping sheet faces, with a folded portion of each booklet facing upward.

29 Claims, 22 Drawing Sheets

SHEET CUTTING DEVICE AND IMAGE FORMING APPARATUS EQUIPPED THEREWITH

BACKGROUND OF THE INVENTION

The present invention relates to a sheet cutter that cuts edges of sheets to true up them for a bundle of sheets after operations of center-stapling processing, center-folding processing and bookbinding processing, and to an image forming apparatus equipped with the sheet cutter.

There have been known TOKKAIHEI Nos. 6-72064, 7-187479 and 8-192951 as a sheet finisher that conducts center-stapling processing for a bundle of sheets in which one set is composed of a plurality of sheets.

Further, there have been proposed TOKKAIHEI Nos. 10-148983 and 10-167562 as a sheet finisher that makes twofold processing possible.

There is available a sheet cutter that cuts edges of sheets to true up them for a bundle of sheets after operations of center-stapling processing, center-folding processing and bookbinding processing. Further, in recent years, there has been proposed an sheet finisher equipped with a sheet cutter wherein edges of sheets are cut by the sheet cutter to true up the sheets after operations of center-stapling processing, center-folding processing and bookbinding processing are conducted like a weekly magazine by the sheet finisher for a bundle of sheets on which images are recorded by an image forming apparatus such as a copying machine, a printer and a compound machine wherein the copying machine and the printer are combined.

(First Problem)

With regard to a booklet stand of a conventional booklet storing means which stores a plurality of booklets which have been cut and are stacked, there are used a booklet stand of a bucket type and that of a conveyer type.

The booklet storing means of a bucket type is one wherein booklets which have been cut are ejected as they are and are stacked on a sheet ejection tray that is fixed at the lower portion on the side of a sheet cutter. On the booklet storing means of this type, storing capacity for booklets is small, and workability for taking out a plurality of booklets collectively is poor.

The booklet storing means of a conveyer type is one that is equipped with a sheet ejection belt that is arranged almost horizontally at the lower portion on the side a sheet cutter, and is rotated. A booklet which has been cut is placed on the rotating sheet ejection belt to be moved, and a succeeding booklet is placed to be overlapped partially with the preceding booklet on the sheet ejection belt to be moved. The booklet storing means of this type requires a long and large sheet ejection belt and has small capacity for stacked booklets.

(Second Problem)

The booklet which has been subjected to center-stapling processing and twofold processing is in a shape in which a portion in the vicinity of a folded section is swelled. After flattening the booklet by pressing the top face including the portion in the vicinity of the folded portion of the booklet with a pressure plate of a pressing means, prior to cutting processing for truing up edges of a booklet, an upper blade of a cutting means is lowered so that the upper blade and a lower blade cut jointly edges of the booklet to true up the edges.

On the conventional sheet cutter, an ascent and descent means for lifting and lowering the pressure plate and a driving means are arranged to be fixed on the upper portion of a booklet conveyance path. Accordingly, when defective conveyance for a booklet is caused in the booklet conveyance path, it is difficult to take out the booklet in the defective conveyance, because of upper mechanisms such as the ascent and descent means in the booklet conveyance path and the driving means.

Further, it is difficult to make the space over the booklet conveyance path to be broad and taking out of the booklet in the defective conveyance is difficult accordingly, because the pressure plate only moves within a range through which a booklet with a maximum thickness can pass.

(Third Problem)

An amount of a protrusion on the edge (an end edge portion) of the trailing edge in the conveyance direction of the booklet which has been subjected to center-stapling processing and twofold processing varies depending on the number of sheets in the booklet. Namely, an edge of the innermost sheet forming the booklet is more protruded than that of the outermost sheet. The more the number of sheets of the booklet is, the greater an amount of protrusion is. Therefore, if cutting is conducted at the fixed position, the edges fail to be trued up by defective cutting. In addition, if cutting is conducted more than needed, the size of the finished booklet turns out to be too small.

(Fourth Problem)

When the front door of the sheet cutter is opened, operations of the driving means of the sheet cutter are stopped, but, it sometimes happens that a user accidentally touches its fingertip to a sharp upper cutting blade and a lower cutting blade of the cutting means in suspension to be injured. In the invention, there is provided a safety device which always prevents that a fingertip of a user is brought into contact to be injured.

(Fifth Problem)

In the sheet cutter of a type wherein a booklet storing section that stores the booklet which has been subjected to edge cutting processing is protruded to be out of an enclosure of a sheet cutter main body, it sometimes happens that a user accidentally stumbles against the protruded sheet storing section to be injured. It further happens that the sheet storing section is hit by a moving object, and damages or troubles are caused. In the invention, there is provided a safety device which prevents that a user hits the sheet cutter to be injured.

(Sixth Problem)

A booklet which has been subjected to center-stapling processing and twofold processing by the sheet finisher is usually ejected from an ejection section located at the lower portion of the sheet finisher. This sheet finisher is provided with an ascending and descending sheet ejection tray capable of storing a large number of sheets which have neither been subjected to center-stapling processing nor been subjected to twofold processing. Under the condition that a sheet cutter is connected to the sheet finisher, if a clearance between a bottom of ascending and descending sheet ejection tray and an upper part of an outer wall of the sheet cutter is small when the ascending and descending sheet ejection tray is lowered to its lower limit position, it happens that a user's hand is caught by the clearance between the ascending and descending sheet ejection tray and the upper part of an outer wall of the sheet cutter to be injured, or objects are caught by the clearance, resulting in occurrence of damages and troubles. In the invention, there is provided a safety device which prevents that a user is injured when driving the sheet finisher.

SUMMARY OF THE INVENTION

The first object of the invention is to attain an improvement of workability of a sheet storing section on which finished booklets are ejected and stacked after edges of a bundle of sheets subjected to center-stapling processing and twofold processing are cut, and to attain an increase of a storing capacity for booklets and miniaturization of the sheet cutter.

The second object of the invention to solve the second problem stated above is to attain an improvement of workability in clearance of jammed booklet (jam clearance) in a cutting means and a conveyance means.

The third object of the invention to solve the third problem stated above is to make the optimum cutting corresponding to the number of sheets of a booklet to be folded double to be possible.

The fourth object of the invention is to provide a safety device so that a user may not be injured in the course of operating the sheet cutter.

The first object stated above can be attained by the following structures each representing a sheet cutter of the invention.

Structure (1):

A sheet cutter for finishing a booklet by cutting, with a cutting means, edges of a bundle of sheets folded double, wherein it is possible to load booklets on a booklet stand of a booklet storing means that stores a plurality of booklets which have been subjected to cutting processing, by overlapping sheet faces, with a folded portion of each booklet facing upward.

Structure (2):

A sheet cutter for finishing a booklet by cutting, with a cutting means, edges of a bundle of sheets folded double, wherein there are provided a rotatable roller with a large diameter which is arranged at the downstream side in the sheet conveyance direction of the cutting means and deflects the booklet subjected to cutting processing to the vertical direction from a conveyance means in the cutting section to convey to a booklet storing means, a pinch roller that presses the booklet against the large diameter roller to convey and is capable of being driven to rotate, and a guide plate that deflects the booklet to the vertical direction from the conveyance means in the cutting section and guides the booklet to the interposing position between the large diameter roller and the pinch roller.

Structure (3):

A sheet cutter for finishing a booklet by cutting, with a cutting means, edges of a bundle of sheets folded double, wherein there are provided a booklet ejection opening through which a booklet subjected to cutting processing passes to a booklet storing means, a booklet stand of the booklet storing means that accepts the booklet from the booklet ejection opening so that the booklets are loaded to be overlapped in terms of sheet faces, with a folded portion of each booklet facing upward, a movable wall member that presses a sheet face of the booklet supported to stand upright on the booklet stand and reciprocates between the topside of the booklet stand and the booklet ejection opening, and a driving means that makes the movable wall member to reciprocate, wherein the movable wall member accepts the booklet that is usually loaded at the stop position on the booklet stand, then, retreats to the rear position of the booklet ejection opening each time a booklet subjected to cutting processing is conveyed to the booklet stand, and returns to the stop position while pressing the sheet face of the booklet to stand ready after the booklet finishes passing through the booklet ejection opening.

Structure (4):

A sheet cutter for finishing a booklet by cutting, with a cutting means, edges of a bundle of sheets folded double, wherein there are provided a booklet ejection opening through which a booklet subjected to cutting processing passes to a booklet storing means, a booklet stand of the booklet storing means that accepts the booklet from the booklet ejection opening so that the booklets are loaded to be overlapped in terms of sheet faces, with a folded portion of each booklet facing upward, a movable wall member that presses a sheet face of the booklet supported to stand upright on the booklet stand and reciprocates between the topside of the booklet stand and the booklet ejection opening, a partition member that is arranged to face a sheet face of the movable wall member and can move in the direction perpendicular to the booklet stand, and a driving means that makes the movable wall member and the partition member to reciprocate, wherein the movable wall member accepts the booklet that is usually loaded at the stop position on the booklet stand, then, retreats to the rear position of the booklet ejection opening each time a booklet subjected to cutting processing is conveyed to the booklet stand, and before the movable wall member retreats for accepting the booklet and the booklet ejection opening is opened, the partition member moves to the position where the end portion of the booklet is accepted in place of the movable wall member, and when the movable wall member moves to the stop position while pressing the sheet face of the booklet, the partition member starts moving to retreat so that the booklet stand may accept the booklet.

Structure (5):

A sheet cutter for finishing a booklet by cutting, with a cutting means, edges of a bundle of sheets folded double, wherein there are provided a booklet stand of a booklet storing means on which a plurality of booklets subjected to cutting processing are accepted and loaded to be overlapped in terms of sheet face with each folded portion facing upward, a movable pressure wall member that is supported to stand upright on the booklet stand and presses the sheet face of the booklet loaded on the booklet stand, and a coil-shaped constant load spring member composed of a long leaf spring that is coiled to urge the pressure wall member.

Structure (6):

A sheet cutter for finishing a booklet by cutting, with a cutting means, edges of a bundle of sheets folded double, wherein there are provided a booklet stand of a booklet storing means on which a plurality of booklets subjected to cutting processing are accepted and loaded to be overlapped in terms of sheet face with each folded portion facing upward, a movable wall member that is supported to stand upright on the booklet stand, presses the sheet face of the booklet loaded on the booklet stand and reciprocates on the booklet stand to support the sheet face of the booklet, and a movable pressure wall member that faces the movable wall member to press the sheet face of a booklet loaded on the booklet stand, and the pressure wall member is composed of a pressure wall face section that stands upright on the aforesaid booklet stand to be in parallel with a sheet supporting wall face of the opposing movable wall member to press the sheet face of the booklet and of an inclined surface section having an inclination angle in the direction wherein the upper part of the pressure wall face goes away from the sheet supporting wall face of the movable wall member.

Structure (7):

An image forming apparatus having therein an image forming means that forms an image on a sheet fed by a sheet feeding means according to image information, a sheet finisher equipped with a stapling means that conducts center-stapling for a bundle of sheets on which images are formed and with a folding means that conducts twofold processing for a bundle of sheets subjected to center-stapling processing, and a sheet cutter described in Structures (1)–(6) stated above, wherein edges of the bundle of sheets subjected to twofold processing and center-stapling are cut by the cutting means to finish a booklet.

The second and third objects mentioned above are attained by the following structures of the invention including sheet cutters.

Structure (8):

A sheet edge cutting method to finish a booklet by cutting edges of a booklet which has been center-stapled and folded double with a cutting means, wherein there is provided a pressing means capable of ascending and descending that presses and separates the top face of a booklet placed at a prescribed position on a conveyance member that conveys the booklet, and the pressing means is driven by a driving means arranged at the lower portion of the conveyance member to press a booklet placed on the conveyance member so that edges of the booklet may be cut and trued up by the cutting means.

Structure (9):

A sheet cutter to finish a booklet by cutting edges of a booklet which has been center-stapled and folded double with a cutting means, wherein there are provided a conveyance means to convey the booklet, a pressing means capable of ascending and descending that presses and separates the top face of a booklet placed on the conveyance means, a ascending and descending means that drives the pressing means to ascend and descend to press and release a top face of a booklet, and a driving means that drives the ascending and descending means, and the ascending and descending means and the driving means are arranged below the conveyance means.

Structure (10):

A sheet cutter to finish a booklet by cutting edges of a booklet which has been center-stapled and folded double with a cutting means, wherein there are provided a conveyance means to convey the booklet, a movable stopper that can move to be in parallel with the conveyance direction for the booklet, a positioning means that positions the movable stopper at a fixed position in accordance with a booklet size, and a control means that adjusts finely the position of the movable stopper from the prescribed position for each size of the booklet in accordance with the number of sheets of a booklet to be folded.

Structure (11):

An image forming apparatus having therein an image forming means that forms an image on a sheet fed by a sheet feeding means according to image information, a sheet finisher equipped with a stapling means that conducts center-stapling for a bundle of sheets on which images are formed and with a folding means that conducts twofold processing for a bundle of sheets subjected to center-stapling processing, and a sheet cutter described in Structures (9)–(10) stated above, wherein sheets on which images have been formed are subjected to center-stapling processing and twofold processing to form a booklet which is then pressed by a pressing means capable of ascending and descending, and edges of the booklet are cut by a cutting means so that the booklet is finished.

The fourth object mentioned above is attained by the following structures of the invention including sheet cutters.

Structure (12):

A sheet cutter to finish a booklet by cutting edges of a booklet which has been center-stapled and folded double with a cutting means, wherein, there is arranged a rotating means for conveying a booklet that prevents that a fingertip of an operator is brought into contact with an upper cutting blade and a lower cutting blade at each of the upstream side and the downstream side of a conveyance path for a booklet that passes through a gap between the upper cutting blade and the lower cutting blade both constituting the cutting means.

Structure (13):

A sheet cutter to finish a booklet by cutting edges of a booklet which has been center-stapled and folded double with a cutting means, wherein, there are provided a sheet cutter main body having therein a conveyance means that conveys the booklet, the cutting means and an ejection means that ejects the booklet subjected to cutting processing out of an apparatus, a booklet storing means that can store a large number of booklets which have been cut and ejected by the ejection means and is protruded out of a sheet cutter main body, and a protection member that is formed to surround the outer circumference of the booklet storing means and is fixed on the sheet cutter main body.

Structure (14):

An image forming apparatus equipped with a sheet finisher having therein a center-stapling means that staples the sheets ejected out of an image forming apparatus main body at their central portion in the conveyance direction and a folding means that folds the sheets center-stapled by the center-stapling means double and with a sheet cutter that is connected to a sheet ejection section of the sheet finisher, conveys with a conveyance means the booklet center-stapled and folded double, and finishes a booklet by cutting edges of a booklet with a cutting means, wherein the sheet finisher has an ascending and descending sheet ejection tray capable of storing a large number of sheets to be ejected, and a prescribed space section is secured between a bottom portion of the ascending and descending sheet ejection tray that has reached its lowermost position and an upper portion of the outer wall of a casing in the vicinity of an inlet of the conveyance means of the sheet cutter.

Figure 13:
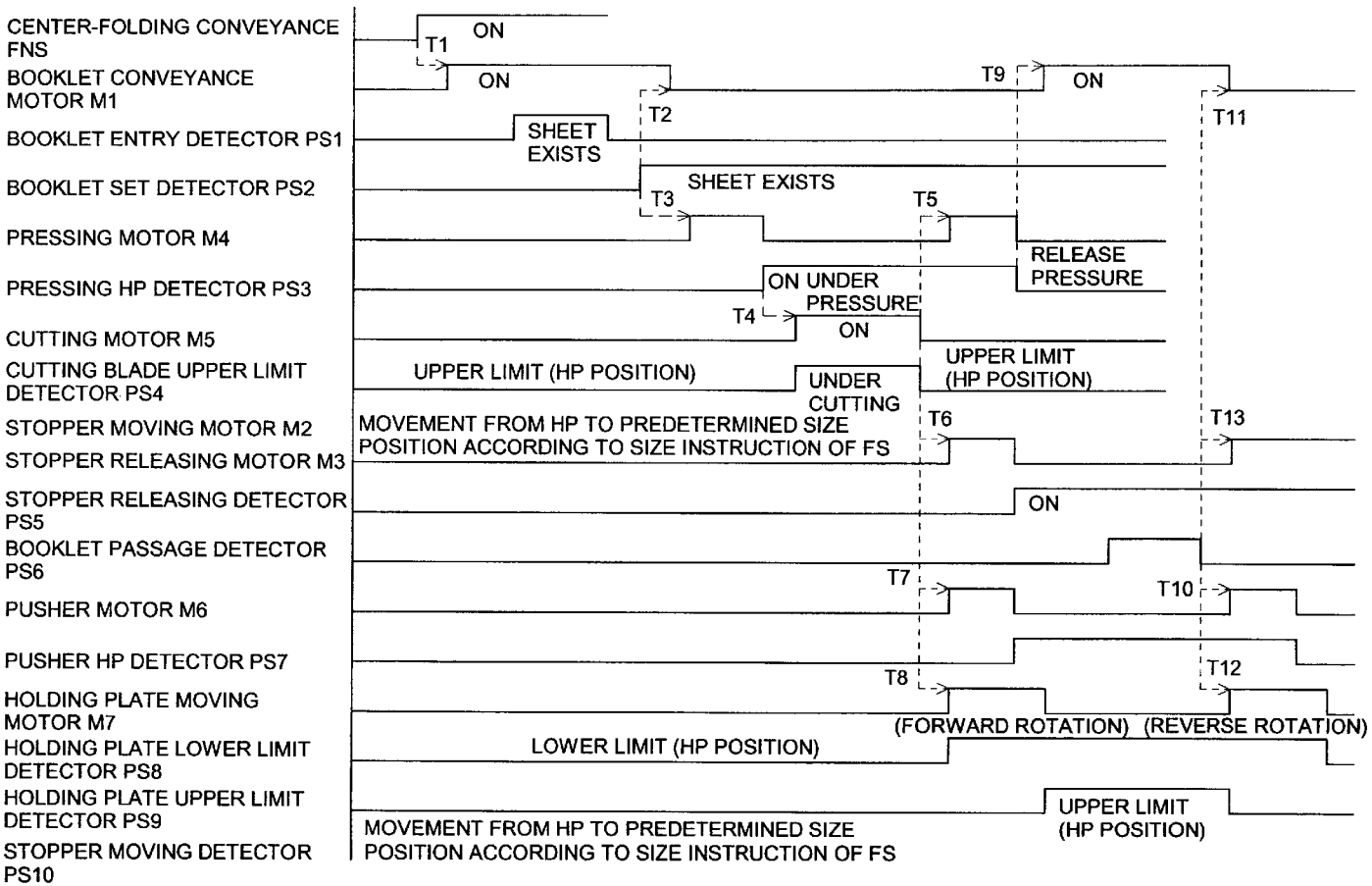

Each of FIGS. 13(*a*)–13(*r*) is a time chart showing the process of storing a booklet in a booklet storing means.

Figure 14:
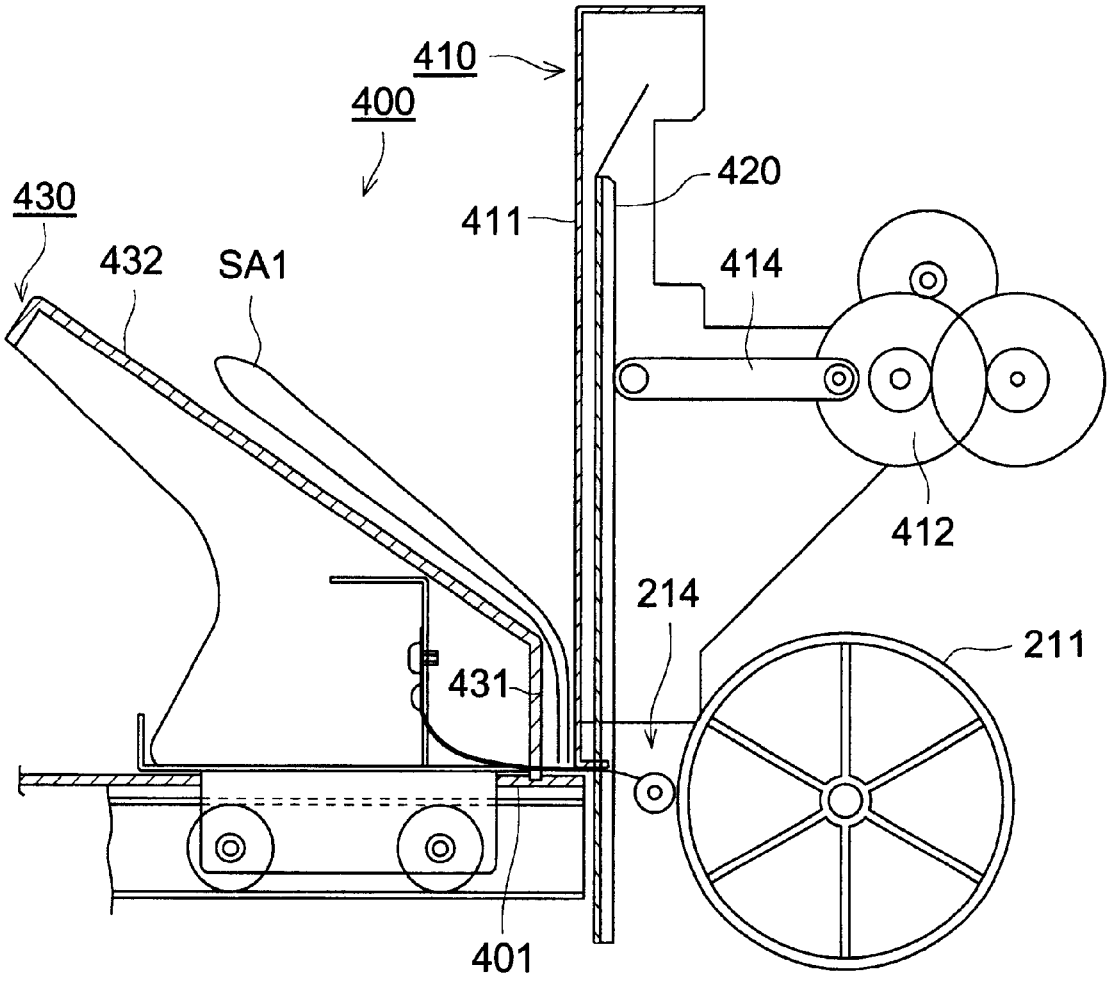

FIG. 14 is a sectional view showing the initial state of the booklet storing means.

Figure 15:
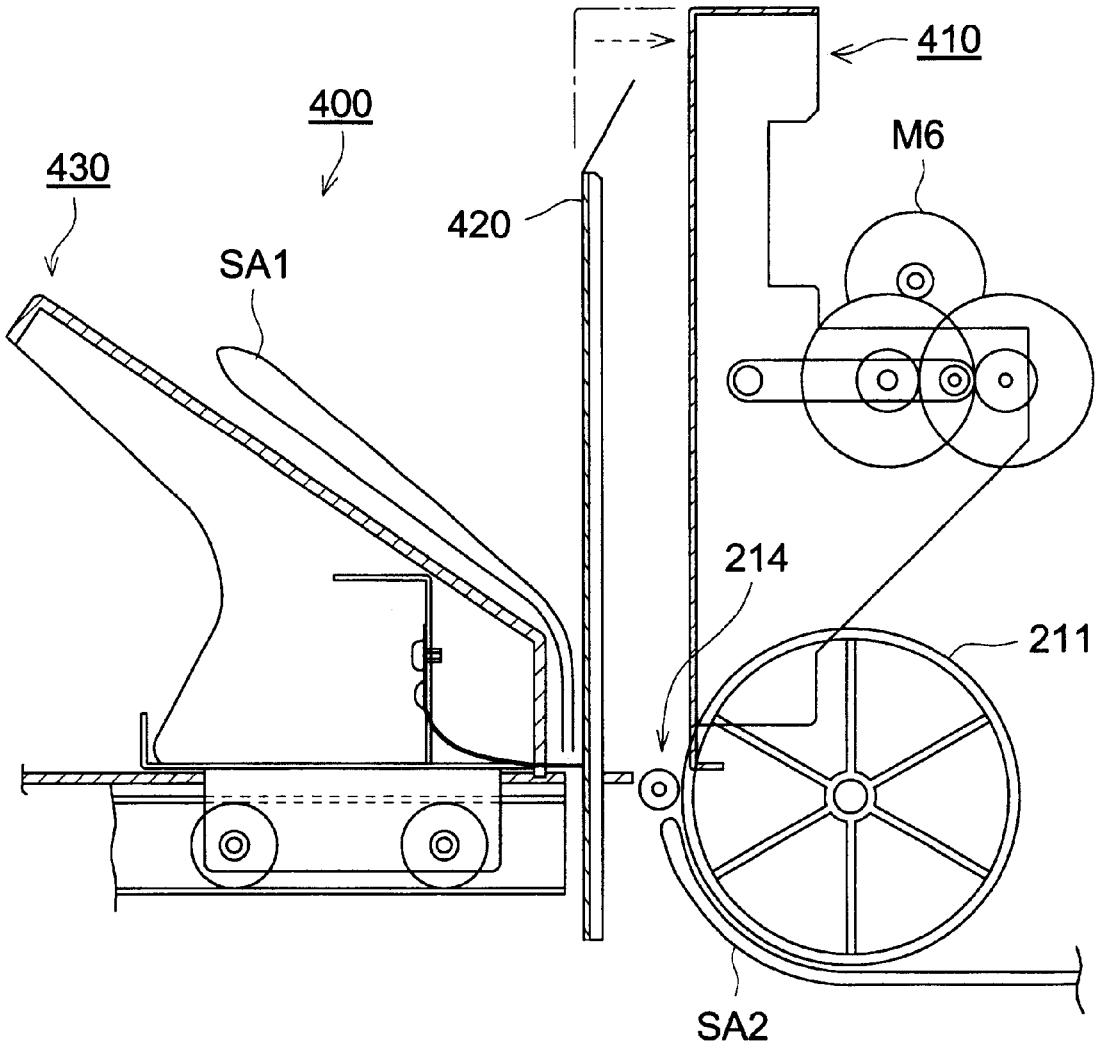

FIG. 15 is a sectional view showing the process of how a booklet is loaded in a booklet storing means.

Figure 16:
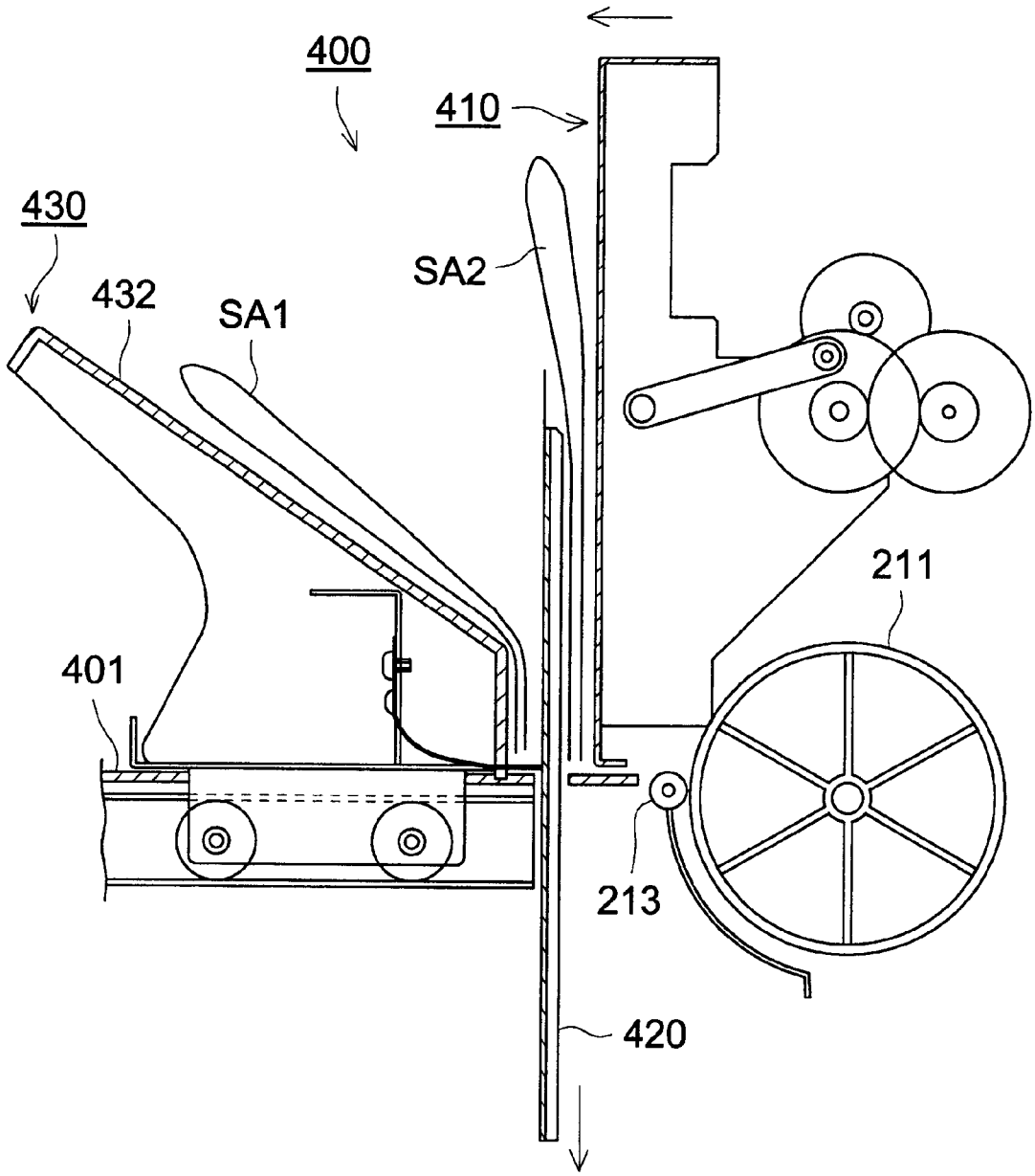

FIG. 16 is a sectional view showing the process of how a booklet is loaded in a booklet storing means.

Figure 17:
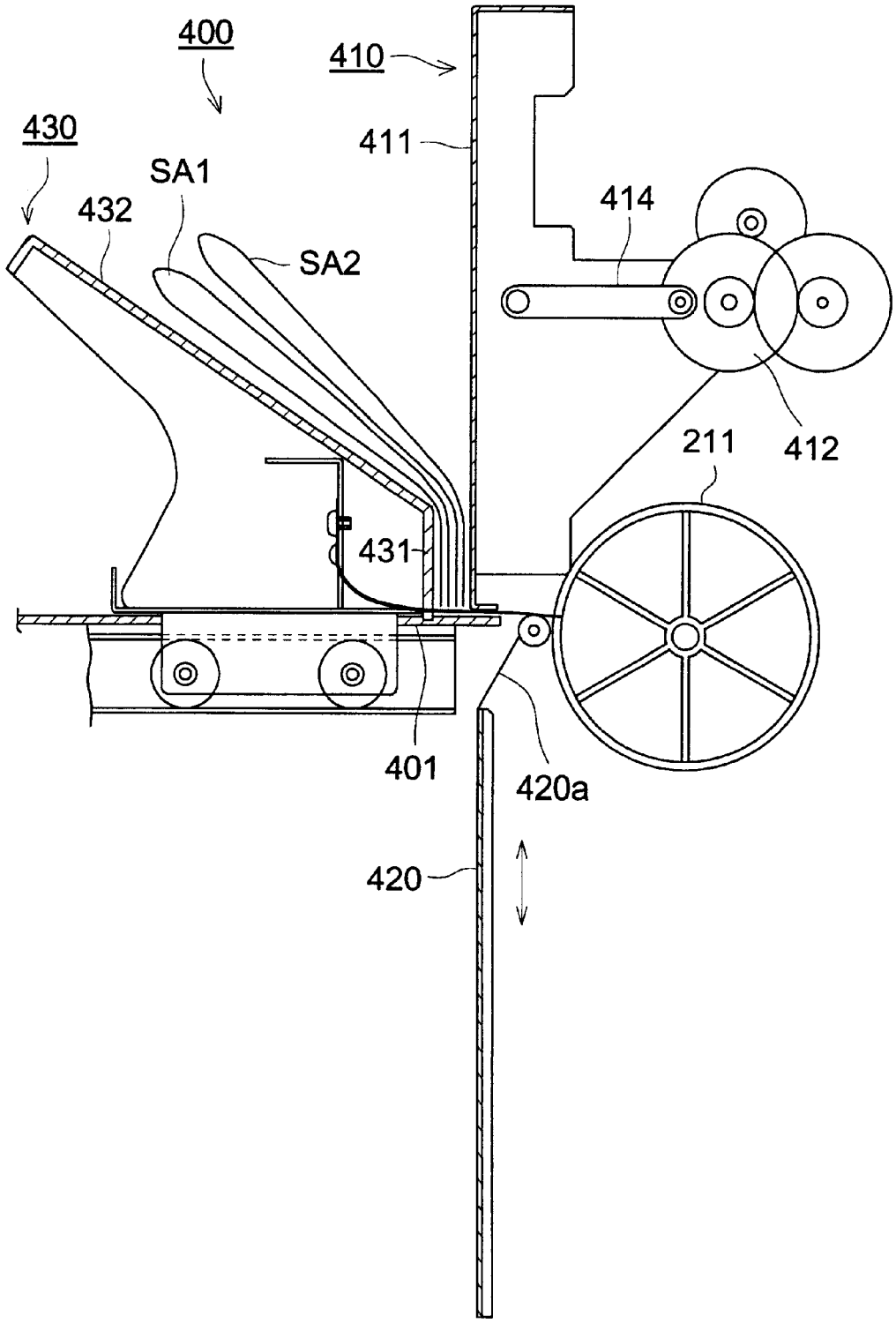

FIG. 17 is a sectional view showing the process of how a booklet is loaded in a booklet storing means.

Figure 18:
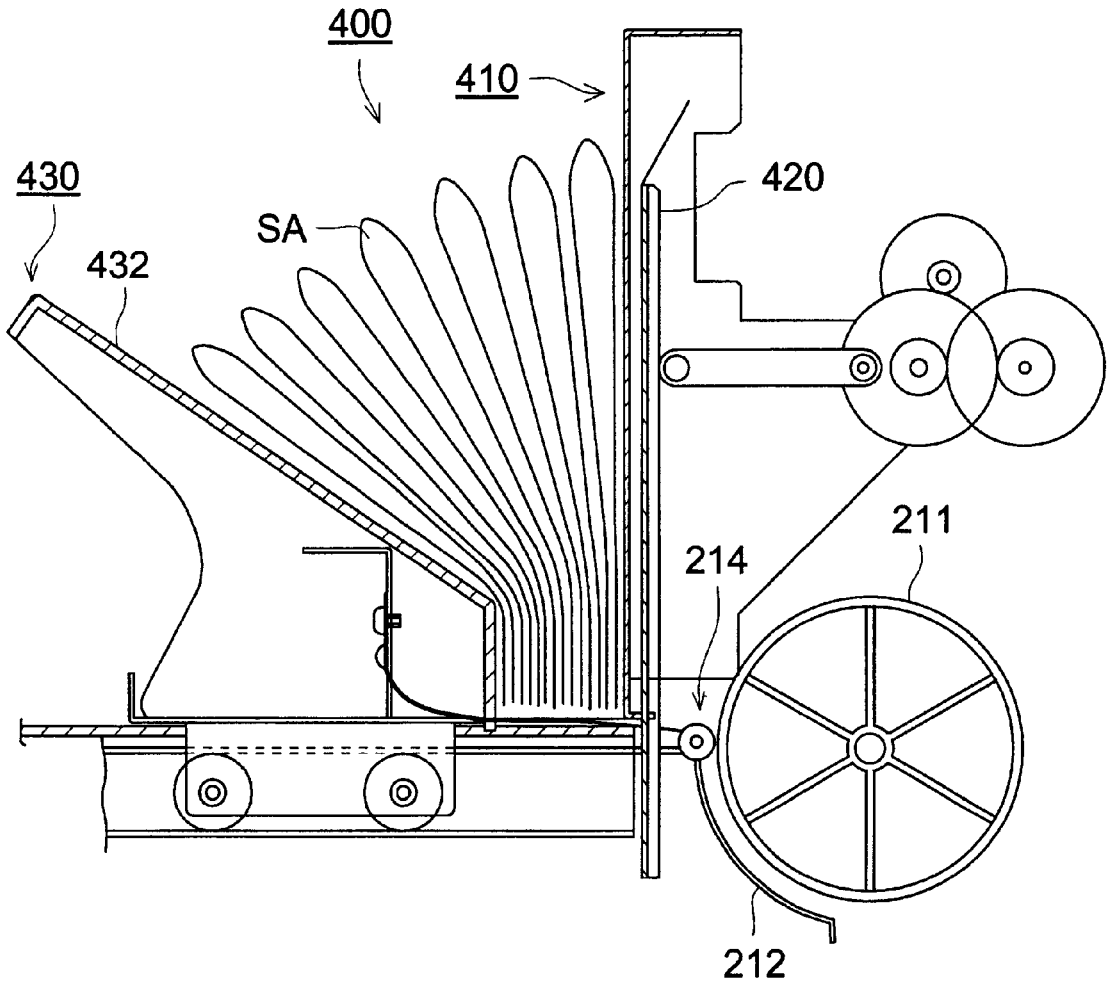

FIG. 18 is a sectional view showing a booklet storing means under the condition that a plurality of sets of booklets are loaded on a booklet stand.

Figure 19:
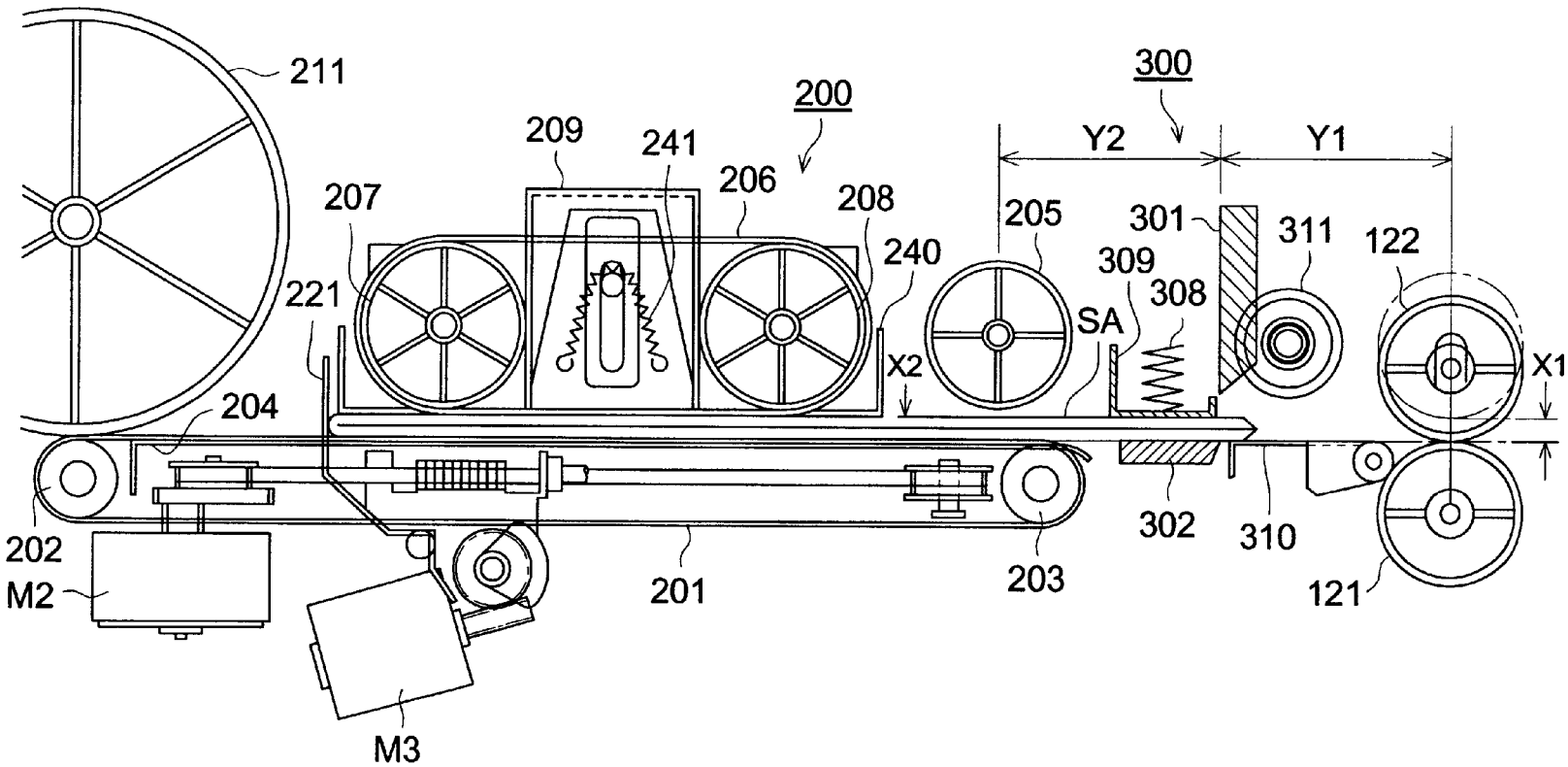

FIG. 19 is a sectional view of the second conveyance means and a cutting means in the case of cutting edges of a booklet.

Figure 20:
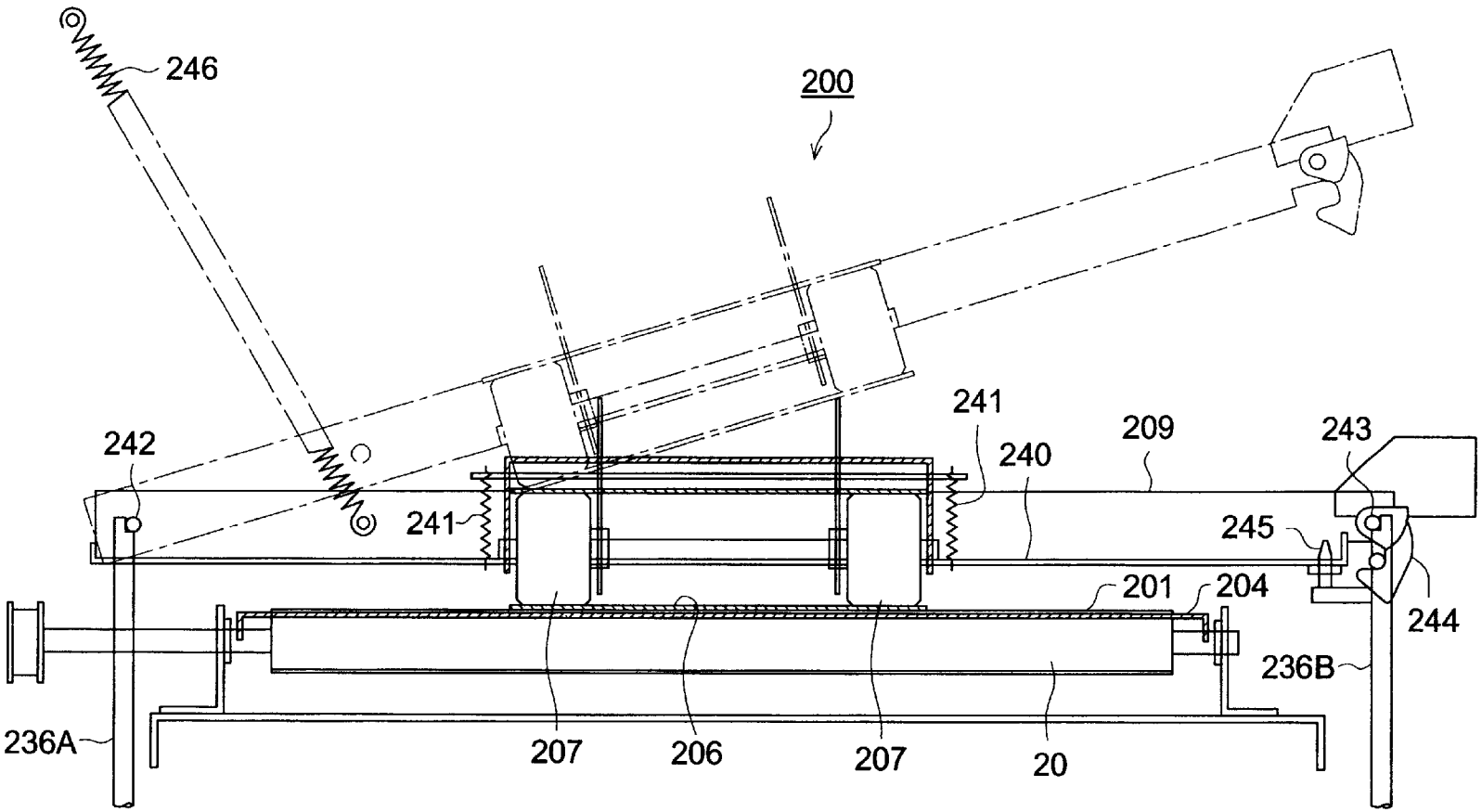

FIG. 20 is a sectional view of a supporting member that supports an upper conveyance belt and a pressure plate.

Figure 21:
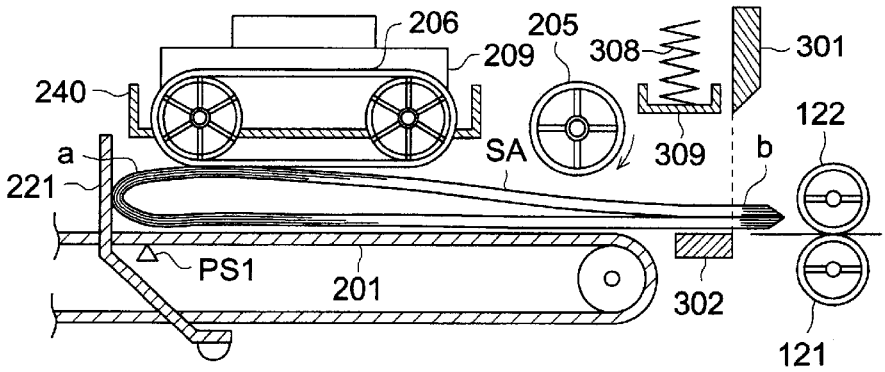
Figure 21:
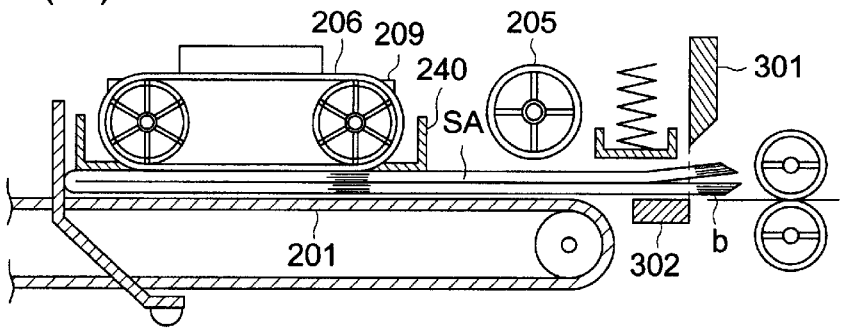
Figure 21:
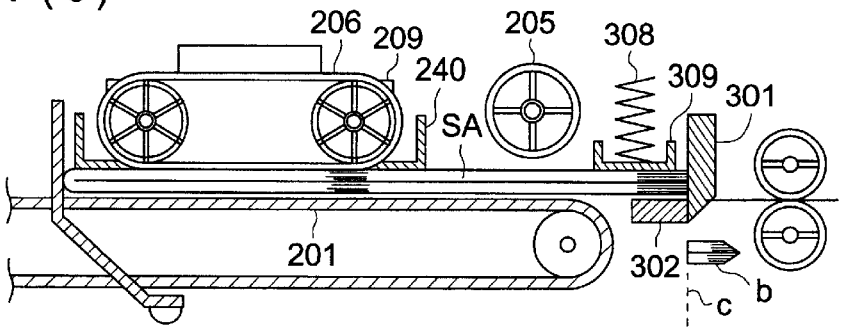
Figure 21:
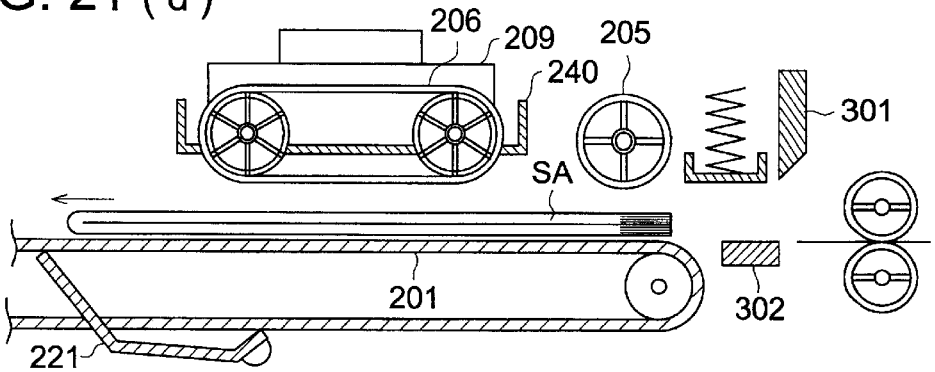

Each of FIGS. 21(*a*)–21(*d*) is an illustration showing the process to cut edge b of booklet SA with a sheet cutter.

Figure 22:
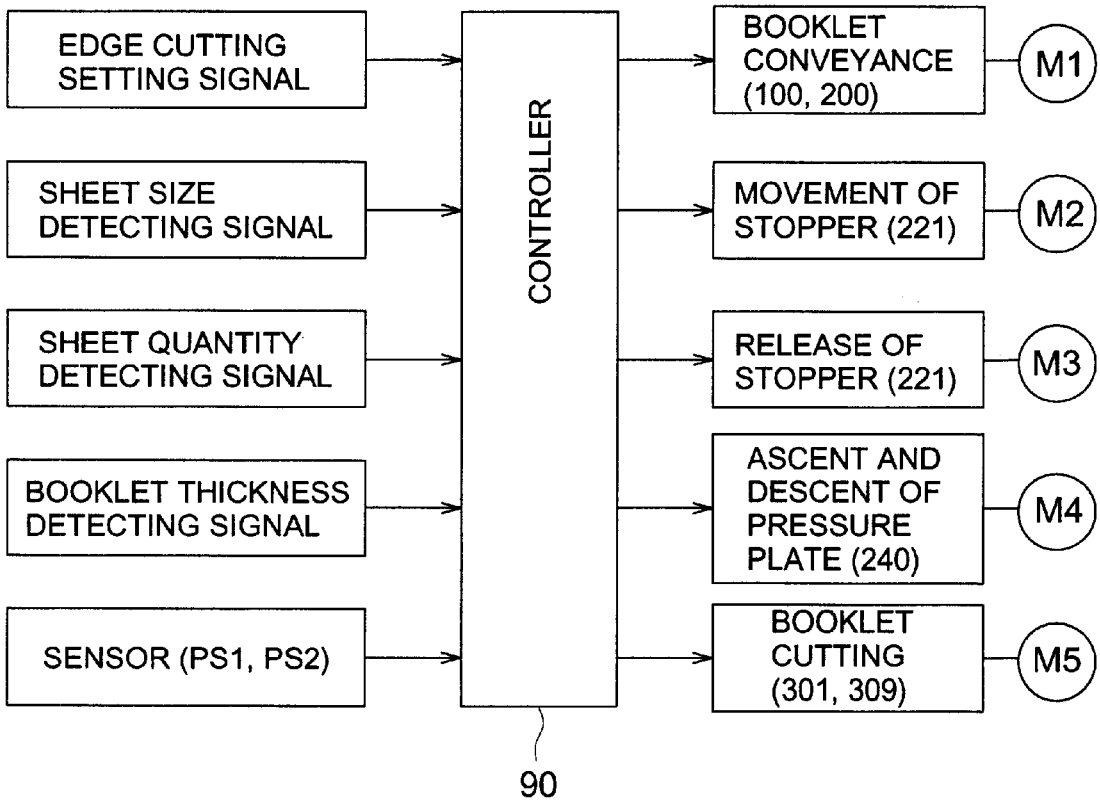

FIG. 22 is a block diagram showing the control of a sheet cutter.

DETAILED DESCRIPTION OF THE PREFERRED EMBODIMENT

Next, a sheet cutter, a sheet finisher and an image forming apparatus equipped with the sheet finisher will be explained as follows, referring to the drawings.

Figure 1:
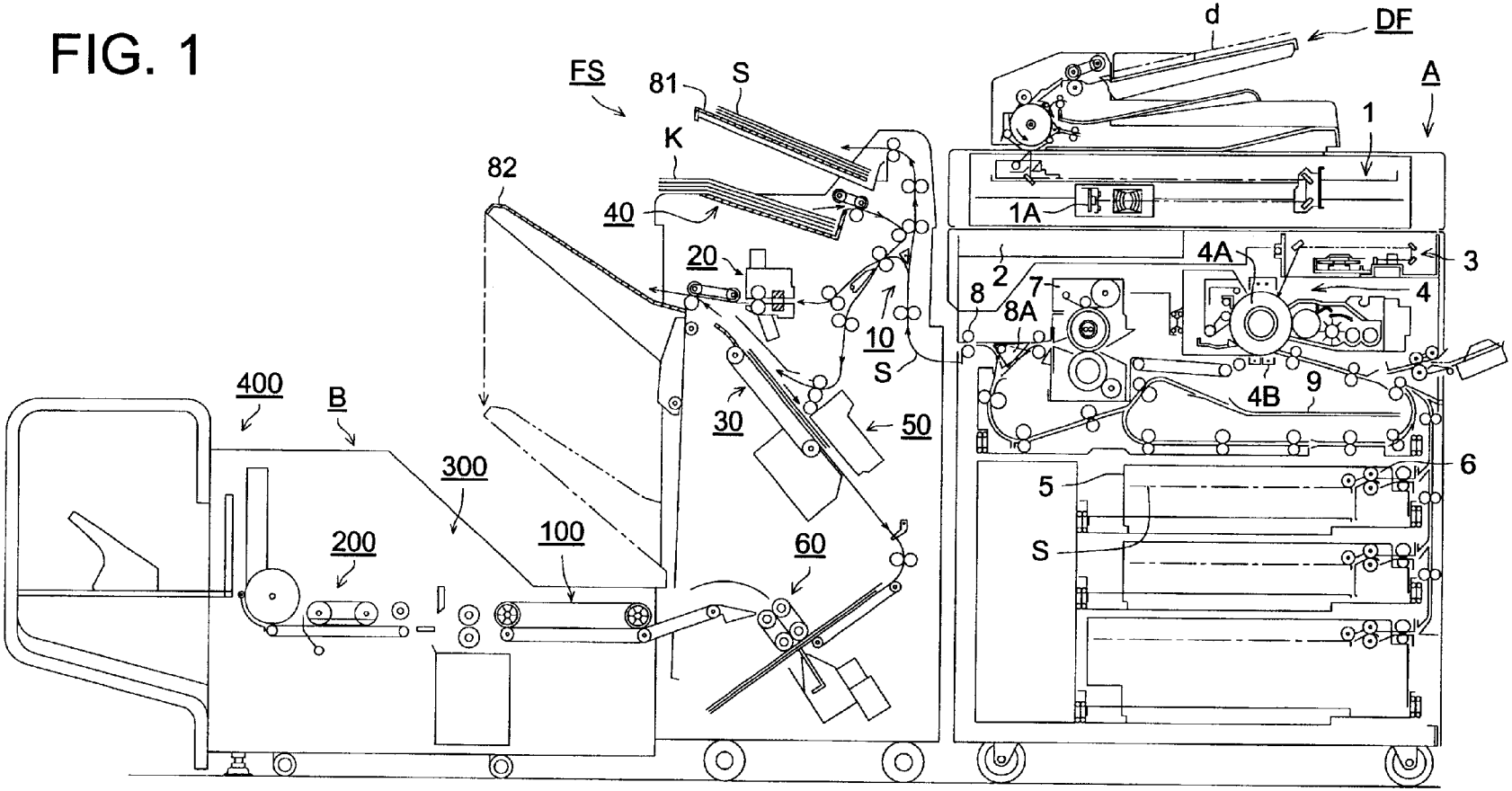
FIG. 1 is a general structural diagram of an image forming system equipped with an image forming apparatus main body, a sheet cutter and a sheet finisher.

FIG. 1 is a general structural diagram of an image forming system equipped with image forming apparatus main body A, sheet cutter B and sheet finisher FS.

The illustrated image forming apparatus main body A is equipped with image reading section 1, image processing section 2, image writing section 3, image forming section 4, sheet-feeding cassette 5, sheet-feeding means 6, fixing device 7, sheet ejection section 8 and automatic two-sided copy sheet-feeding section (ADU) 9.

On the image forming apparatus main body A, there is mounted automatic document feeding device DF. To the sheet ejection section 8 side on the illustrated left side of the image forming apparatus main body A, there is connected sheet finisher FS equipped with sheet cutter B.

Document "d" placed on a document stand of automatic document feeding device DF is conveyed in the arrow direction, and images on one side or both sides of the document are read by an optical system of image reading section 1 and are read in CCD image sensor 1A.

An analog signal resulted from photoelectric conversion of CCD image sensor 1A is subjected to analog processing, A/D conversion, shading correction and image compression at image processing section 2, and then, a signal is sent to image writing section 3.

In the image writing section 3, light output from a semiconductor laser is projected on photoreceptor drum 4A of image forming section 4, and a latent image is formed. In the image forming section 4, there are conducted charging, exposure, development, transfer, separation and cleaning. An image is transferred onto sheet (recording sheet) S fed by sheet-feeding means 6 from sheet-feeding cassette 5. The sheet S carrying the image is fixed by fixing device 7, and then is fed in sheet finisher FS from sheet ejection section 8. Or, sheet S whose one side has been subjected to image processing that has been fed in automatic two-sided copy sheet feeding section 9 is subjected to two-sided image processing again in the image forming section 4, then ejected from sheet ejection section 8 to be subjected to center-stapling processing and twofold processing in sheet finisher FS, and is fed in sheet cutter B.

Figure 3:
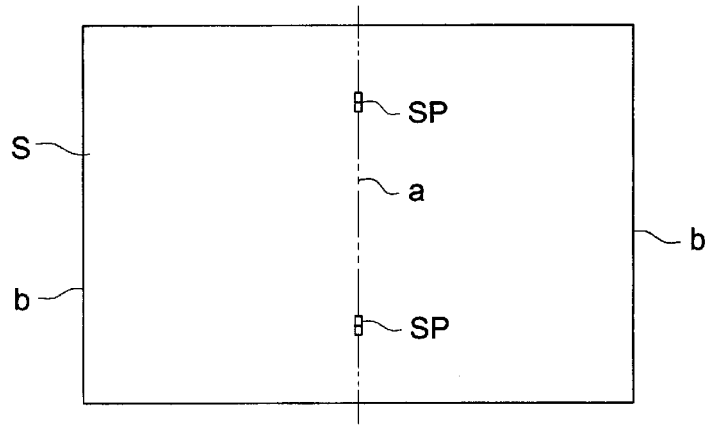
FIG. 3(*a*) is a top view of a center-stapled sheet, FIG. 3(*b*) is a perspective view of a booklet subjected to finishing of center-stapling and twofold processing, FIG. 3(*c*) is a perspective view showing the opened booklet, and FIG. 3(*d*) is a sectional view of the booklet.
Figure 3:
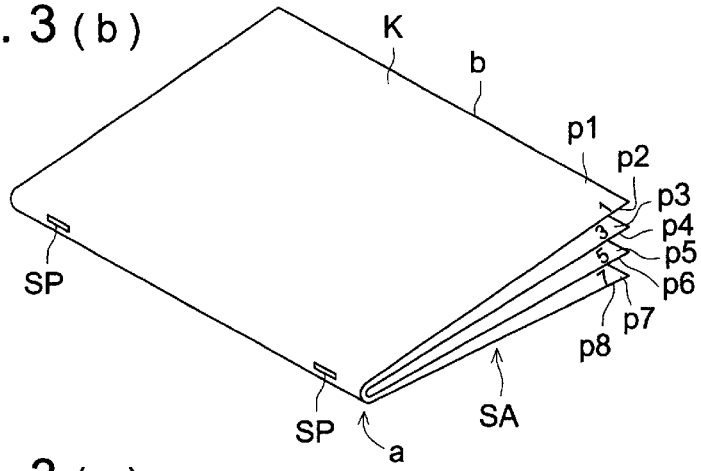
Figure 3:
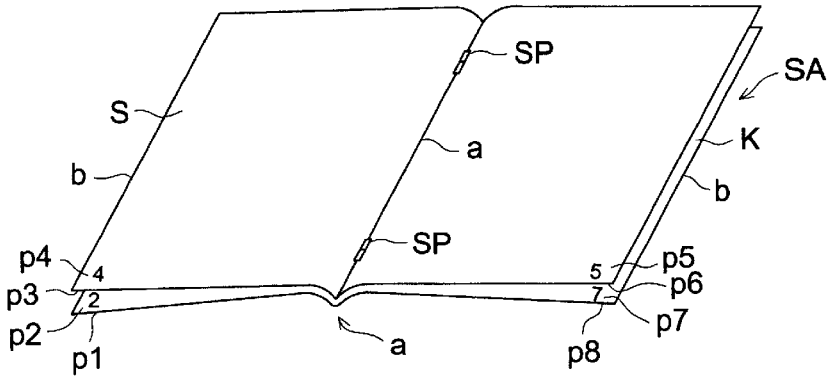
Figure 3:
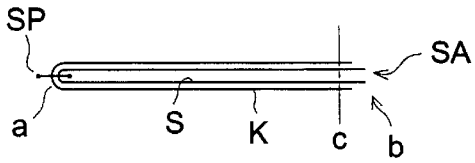

The sheet cutter B is one that cuts edges and vicinity of bundle of sheets S which have been center-stapled and folded double by sheet finisher FS as shown in FIG. 3(*d*) to align edges "b", which will be explained in detail on FIG. 4 and thereafter.

In the sheet finisher FS, there are arranged, almost vertically and longitudinally in the order from the top in the illustration, fixed sheet ejection tray 81, cover feeding means 40, shift processing conveyance section 20, first loading section 30, stapling means 50 and folding means 60.

On the upper portion on the right in the illustration of the sheet finisher FS, there is arranged inlet conveyance section 10. Further, on the left side in the illustration of the sheet finisher FS, there is arranged on which end-stapled and shift-processed sheets are stacked.

Figure 2:
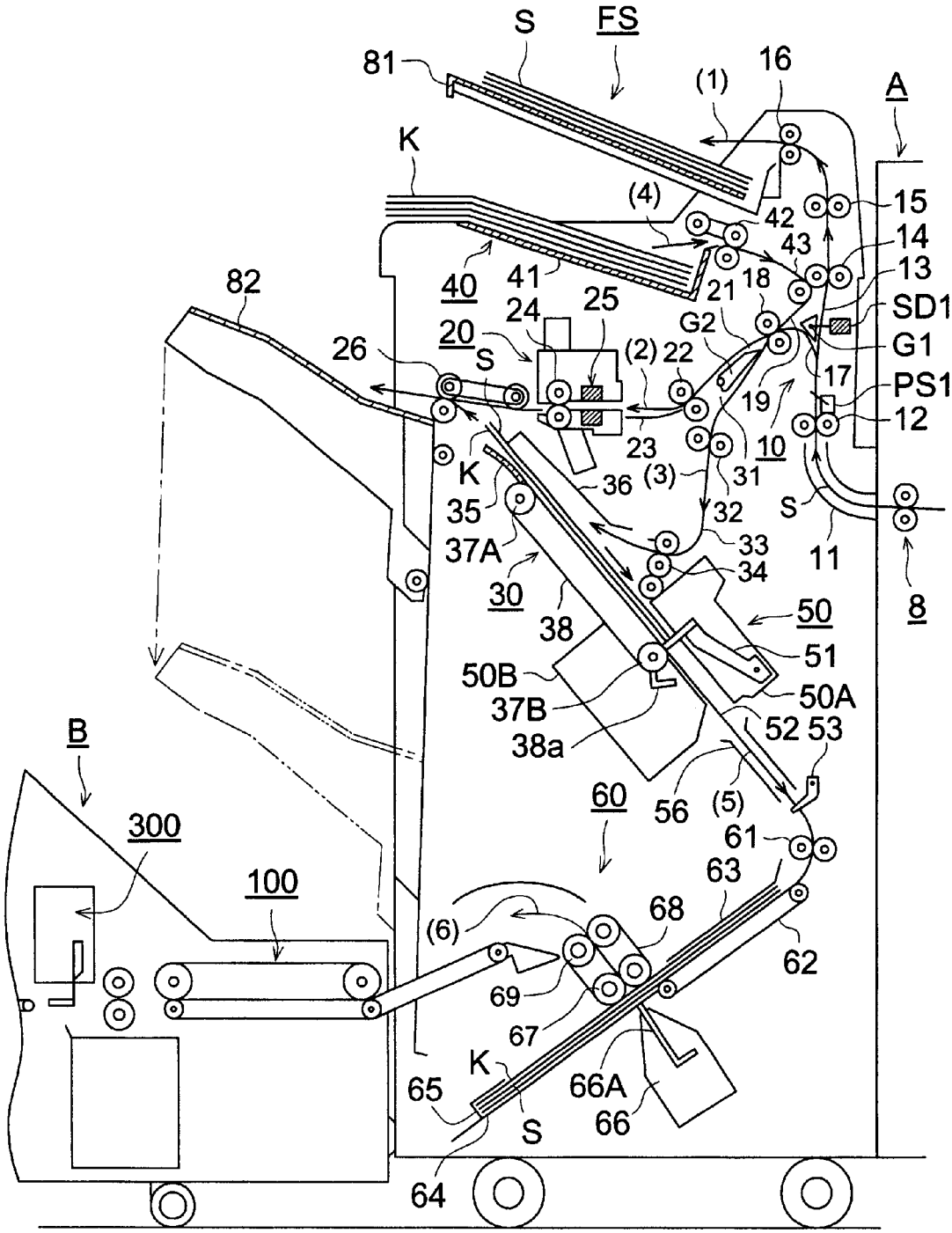
FIG. 2 is an illustration showing a sheet conveyance path of a sheet finisher.

FIG. 2 is an illustration showing a sheet conveyance path of the sheet finisher FS.

The sheet finisher FS is installed after an adjustment of its position and height so that inlet section 11 for sheet S conveyed from image forming apparatus main body A may agree with sheet ejection section 8 of the image forming apparatus main body A.

A conveyance path for sheet S connected to the downstream side of inlet section paired rollers 12 at inlet section 11 in the sheet conveyance direction is branched into three systems of first conveyance path (1) on the upper deck, second conveyance path (2) on the medium deck and third conveyance path (3) on the lower deck, and sheet S is fed into either conveyance path depending on the selection of an angle formed by switching gates G1 and G2.

(1) Non-staple, Non-sort (First Conveyance Path (1))

Sheet S that has been ejected out of the image forming apparatus main body A and has an image formed thereon is guided to inlet section 11 to be conveyed by inlet section paired rollers 12, and a length of the sheet S in the conveyance direction is detected by inlet passage sensor PS1. The sheet S passes through path 13 on the right side of first switching gate G1 located at the upper portion, then, is interposed by upper conveyance paired rollers 14 and by conveyance paired rollers 15 to be conveyed upward, and is further interposed by ejection rollers 16 to be ejected on fixed sheet ejection tray 81 located at the upper portion outside an apparatus, and is stacked thereon in succession.

In the course of this sheet conveyance, the switching gate G1 is driven by solenoid SD1 to swing to close path 17, to make the path 13 to be opened, and to make passage of the sheet S to the fixed sheet ejection tray 81 possible.

(2) Shift Processing or Non-Sort (Second Conveyance Path (2))

When established to this conveyance mode, switching gate G1 closes path 13, holds path 17 to be on the state of open and makes it possible for sheet S to pass the path 17, with solenoid SD1 staying to be off.

Sheet S that has been ejected out of the image forming apparatus main body A and has an image formed thereon passes through inlet section 11 and inlet section paired rollers 12, then, passes through path 17 formed to be in the state of open under switching gate G1 to be interposed by conveyance paired rollers 18, and passes through path 21 above second switching gate G2 that represents second conveyance path (2) and is located downward obliquely to be interposed by conveyance paired rollers 22 and to be interposed by shifting means 25 and shift paired rollers 24 through path 23, thus, the sheet S is ejected out by ejection paired rollers 26 to be stacked on ascending and descending sheet ejection tray 82.

(3) Edge-Stapling Processing (Third Conveyance Path (3))

Sheet S to be edge-stapled or center-stapled is subjected to image forming in the image forming apparatus main body A, then, is fed in inlet section 11 of sheet finisher FS, and passes though inlet paired rollers 12 and path 17 below first switching gate G1 to be interposed by conveyance paired rollers 18, and is conveyed to third conveyance path (3).

In the third conveyance path (3), sheet S passes through path 31 located under switching gate G2, and is interposed and conveyed by conveyance paired rollers 32 on the downstream side. The sheet S is further interposed by conveyance paired rollers 34 located on the downstream side to be fed out and is ejected to the space above intermediate stacker 35 representing first loading section 30 that is arranged obliquely to come in contact with intermediate stacker 35 or with a top face of sheet S stacked on intermediate stacker 35. After sliding upward, the sheet S starts descending by its own weight after the trailing edge of the sheet S in its advancement direction has passed the conveyance paired rollers 34, then, the sheet S slides down along an inclined surface of intermediate stacker 35, and it stops with its leading edge in its advancement direction hitting a sheet stopper surface of movable stopper member (hereinafter referred to as edge-stapling stopper) 51 for edge stapling in the vicinity of stapling means 50.

The numeral 36 represents a pair of upstream side width regulation means provided movably on both sides of intermediate stacker 35. The upstream side width regulation means 36 can move in the direction perpendicular to the sheet conveyance direction, and in the case of sheet receiving where sheet S is ejected on intermediate stacker 35, the upstream side width regulation means is opened to be broader than a sheet width, to be conveyed on the intermediate stacker 35, and when the sheet S comes in contact with edge-stapling stopper 51 to be stopped, the sheet S is tapped on its side in the lateral direction for truing up (width regulation) of a bundle of sheets.

When the prescribed number of sheets S are stacked and regulated on intermediate stacker 35 at this stop position, stapling processing is conducted by stapling means 50 and a bundle of sheets are stapled.

On a part of a sheet loading surface of the intermediate stacker 35, there are rotatably provided a plurality of ejection belts 38 each being trained about driving pulley 37A and driven pulley 37B. A bundle of sheets stapling-processed is placed on ejection belt 38 with the trailing edge of the sheet S being held by ejection claw 38*a* of the ejection belt 38 to slide on the loading surface of intermediate stacker 35 to be lifted upward obliquely, and advances to the nipping position of ejection paired rollers 26. A bundle of sheets interposed by rotating ejection paired rollers 26 is ejected and stacked on ascending and descending sheet ejection tray 82.

(4) Cover Feeding (Fourth Conveyance Path (4))

Cover feeding means 40 is composed of cover placing section 41 and cover feeding section 42.

A sheet of cover K fed from the cover feeding means 40 passes through path 43, then passes through another nipping position of conveyance paired rollers 14, and passes through path 19 and conveyance paired rollers 18 to arrive at intermediate stacker 35 through conveyance paired rollers 32, path 33 and conveyance paired rollers 34 all of third conveyance path (3).

(5) Center-Stapling (Fifth Conveyance Path (5))

Stapling means 50 is constituted to be of a half-split structure of upper mechanism 50A and lower mechanism 50B, and between them, there is formed path 52 through which sheet S can pass.

Two sets of stapling means 50 are arranged in the direction perpendicular to the sheet conveyance direction, and they can be moved by an unillustrated driving means in the direction perpendicular to the sheet conveyance direction. Staples SP are stapled by the stapling means 50 at two symmetrical locations in the lateral direction.

When sizes (length in the longitudinal direction) of cover K and sheet S are set or detected under establishment of the center-stapling mode, movable stopper member for center-stapling (hereinafter referred to as center-stapling stopper) 53 moves to the prescribed position and stops. Edge-stapling stopper 51 retreats interlocking with the start of the center-stapling stopper 53 and opens path 52.

After cover K is placed at the prescribed position on intermediate stacker 35, sheet S conveyed out of image forming apparatus main body A passes through third conveyance path (3) from inlet conveyance section 10 of sheet finisher FS to be stacked successively on the top face of the cover K placed on the intermediate stacker 35, and an edge portion of the sheet S comes in contact with center-stapling stopper 53 to be positioned. The numeral 56 represents a downstream side width regulating means that regulates sheet S in its lateral direction in the course of center-stapling processing, and it taps a side of the sheet S in the lateral direction to regulate a width each time a sheet of sheet S is fed in, in the same way as in the upstream side width regulation means 36 stated above.

Further, in the course of center-stapling processing, the upstream side width regulation means 36 and the downstream side width regulating means 56 are operated simultaneously, at the proper time when sheet S hits center-stapling stopper 53, for sheet S being conveyed on intermediate stacker 35 and advancing on the upstream side of stapling means 50, and thereby, sheet width regulation is conducted to true up sheets.

In this way, width regulation is conducted accurately for the entire length of sheet S by the upstream side width regulation means 36 and the downstream side width regulating means 56, for sheet S and cover K which advance on intermediate stacker 35 and are stacked to be spread toward the upstream side and the downstream side with stapling means 50 as the center.

After the final sheet S is placed to be positioned on intermediate stacker 35, center-stapling processing is conducted by stapling means 50 on a bundle of sheets composed of cover K and all pages of sheet S. Due to this center-stapling processing, a staple is stapled at the central portion of the cover K and sheet S in the conveyance direction. Staple SP is stapled in the direction from lower mechanism 50B having the driving side for stapling a staple to upper mechanism 50A having the clinching side for a staple.

(6) Twofold Processing (Sixth Conveyance Path (6)) (See FIG. 2)

After the center-stapling processing, center-stapling stopper 53 swings to open a path on the downstream side of path 52. A bundle of sheets composed of center-stapled cover K and sheet S passes through a curved path and intermediate conveyance paired rollers 61, then, is conveyed by conveyance belt 62 that is located downward obliquely while being guided by guide plate 63, and is further conveyed on second loading section (stack stand) 64 to be stopped at the prescribed position with a leading edge portion of the bundle of sheets in the conveyance direction coming in contact with folding section movable stopper means 65. The folding section movable stopper means 65 can be moved to the prescribed position by setting or detection of the sheet size and by a driving means.

Folding means 60 is composed of sheet thrusting means 66, folding roller 67, conveyance belt 68 and pressure roller 69.

With a signal to start folding double, thrusting plate 66A of sheet thrusting means 66 advances straight upward obliquely, and thereby, a tip portion of the thrusting plate 66A pushes up the central portion of the bundle of sheets composed of cover K and sheets S to push a nip portion of folding roller 67 open through a bundle of sheets so that the folding roller 67 may swing and separate.

After the tip portion of the thrusting plate 66A passes through the nip portion, the thrusting plate 66A retreats, and the central portion of the bundle of sheets is nipped and pressed by folding roller 67, and thereby, a crease section is formed. This crease section agrees with a position where a staple is stapled into the bundle of sheets subjected to the center-stapling processing. This center-stapling processing and center-folding processing can be conducted for sheets in a lump in quantity up to the maximum of 64 pages (16 sheets).

A central portion of the bundle of sheets on which a crease section is formed when the bundle of sheets is nipped and pressed by rotating paired folding rollers 67 is nipped by paired conveyance belts 68 to be conveyed, and then is fed in a nipping position of paired pressure rollers 69 where the crease section is formed more firmly to be ejected.

FIG. 3(*a*) is a top view of a sheet showing center-stapling processing wherein staples SP are stapled at two symmetrical positions along crease section "a" for folding sheet S double, FIG. 3(*b*) is a perspective view of booklet SA which has been center-stapled and folded double, FIG. 3(*c*) is a perspective view showing how sheet-finished booklet SA is opened double, and FIG. 3(*d*) is a sectional view of booklet SA which has been center-stapled and folded double. In these drawings, "b" represents edges on the side end portion of sheet S, and "c" represents a cutting line for truing edges up.

With regard to booklet SA which has been subjected to center-stapling processing and twofold processing, a first surface (p1, p8) of cover K faces outside, a second surface (p2, p7) is arranged on the reverse side of the first surface, a first surface (p3, p6) of sheet S representing contents is arranged inside the second surface stated above, and a second surface (p4, p5) of sheet S is arranged inside the first surface of sheet S, thus, pages of the booklet composed of 8 pages (p1–p8) can be put in order as shown in the drawing.

In the operation section of image forming apparatus main body A, when a booklet-making automatic mode is selected and set, then, cover K is placed on cover-placing section 41 and when printing is started, the control section of the image forming apparatus main body A makes the image process stated above to be conducted, sheet S carrying an image is subjected to center-stapling processing and twofold processing by sheet finisher FS, thus, booklets SA are made and ejected continuously.

In the operation section of the sheet finisher FS, when a booklet-making manual mode is selected and set, then, cover K is placed on cover-placing section 41 and sheet S equivalent to one set of booklet on which images have been formed is placed under the cover K on the cover-placing section 41, and when feed-out operations are started, the cover K and sheet S are subjected to center-stapling processing and twofold processing by the control section of the sheet finisher FS, thus, a booklet equivalent to one set is made and ejected.

Figure 4:
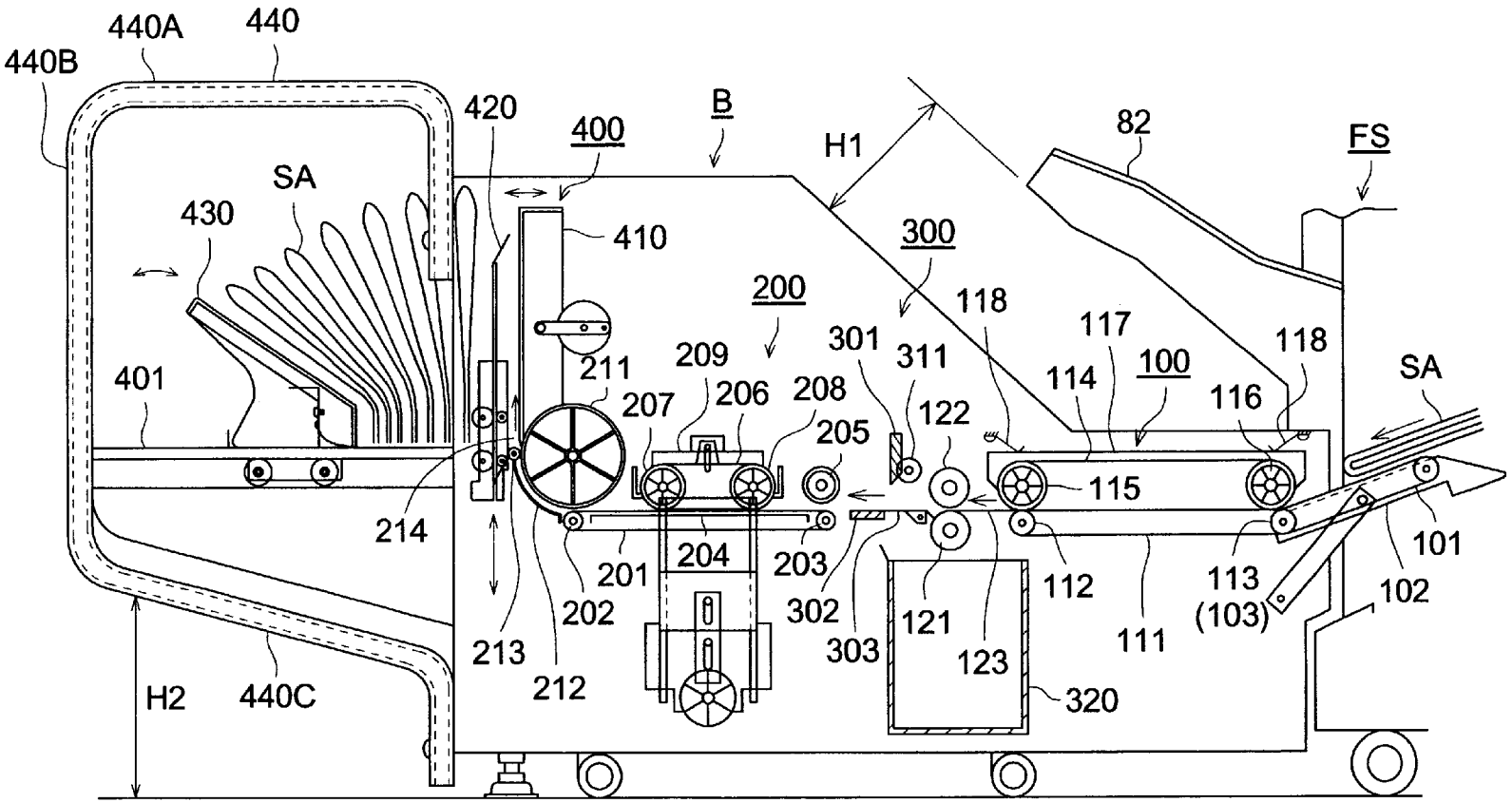
FIG. 4 is a general structural diagram of a sheet cutter of the invention.

FIG. 4 is a general structural diagram of sheet cutter B of the invention. The sheet cutter B is composed of first conveyance means 100, second conveyance means 200, cutting means 300 and booklet storing means 400.

Figure 5:
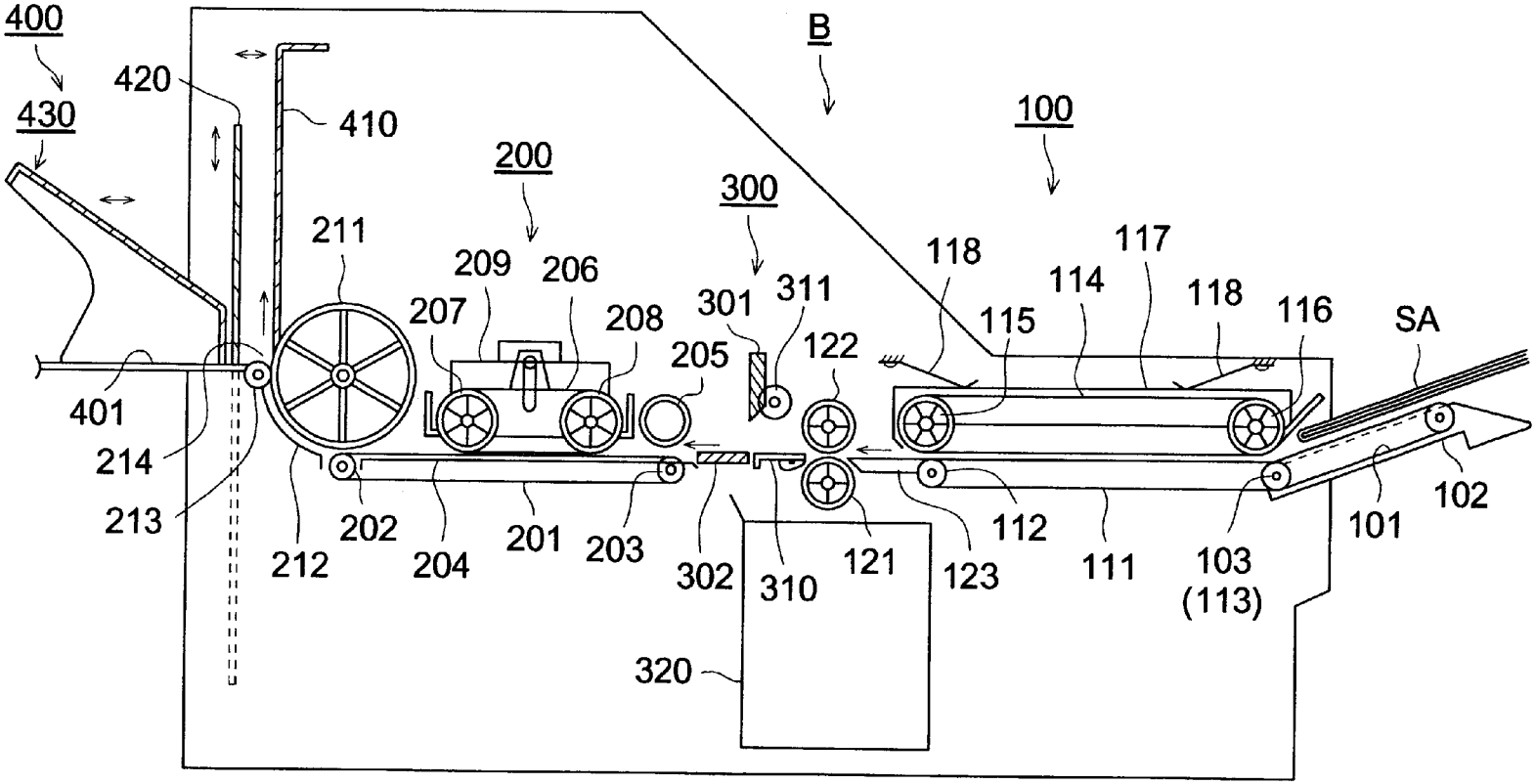
FIG. 5 is a sectional view showing a sheet conveyance path of sheet cutter.

FIG. 5 is a sectional view showing a sheet conveyance path of the sheet cutter B.

Booklet SA which has been folded double by folding means 60 of sheet finisher FS is ejected on conveyance belt 101 arranged at an inlet section of the sheet cutter B. The conveyance belt 101 is supported rotatably by supporting member 102, and is rotated by driving roller 103.

Lower conveyance belt 111 trained about driving roller 112 and driven roller 113 is arranged rotatably on the downstream side of the conveyance belt 101 in the sheet conveyance direction. Upper conveyance belt 114 is in pressure contact with the lower conveyance belt 111 to be driven to rotate. The upper conveyance belt 114 trained about rollers 115 and 116 is supported rotatably by supporting member 117 which is urged by spring 118 to make the upper conveyance belt 114 to be in pressure contact with the lower conveyance belt 111. Booklet SA conveyed by the conveyance belt 101 is pressed by and interposed between the lower conveyance belt 111 and the upper conveyance belt 114 to be conveyed.

On the downstream side of the lower conveyance belt 111 in the sheet conveyance direction, there are arranged driving roller 121 connected with a driving means and driven roller 122 that is in pressure contact with the driving roller 121 to rotate. Booklet SA interposed between and conveyed by the lower conveyance belt 111 and the upper conveyance belt 114 passes through guide plate 123, and is interposed between the driving roller 121 and the driven roller 122 to be conveyed.

On the downstream side of the driving roller 121 in the sheet conveyance direction, there is arranged cutting means 300 that is composed of upper cutting blade 301, lower cutting blade 302, movable plate 310, pressure roller 311 and wastebasket. The cutting means 300 will be explained in detail later.

A horizontal surface of a casing of sheet cutter B located above first conveyance means 100 is made to be long by setting a distance between an inlet section of the sheet cutter B and the cutting means 300 to be long. Further, a space above the cutting means 300 is kept to be minimum and a surface of a casing of the sheet cutter B is made to be an inclined surface.

By forming a casing of the sheet cutter B in a way stated above, prescribed space section H1 can be secured between a bottom portion of ascending and descending sheet ejection tray 82 and an upper portion of an outer wall of a casing of sheet cutter B, when ascending and descending sheet ejection tray 82 of finisher Fs arrives at its lower limit position. This space section H1 was set to about 120 mm. The space section H1 prevents that a hand of a user is caught between the ascending and descending sheet ejection tray 82 which is descending and an upper portion of an outer wall of a casing to be injured when driving the sheet finisher, or an object is caught between them to cause damage or troubles.

Booklet SA whose edge b is cut by cutter means 300 and finished is interposed by rotating lower conveyance belt 201, upper conveyance belt 206 that is driven to rotate and upper roller 205 that is driving to rotate, in the second conveyance means 200.

The lower conveyance belt 201 is rotated by driving roller 202 connected to a driving means. The numeral 203 represents a driven roller that is driven by the lower conveyance belt 201 to rotate. Conveyance supporting plate 204 is fixed at a position that is in the vicinity of the booklet conveyance path and is inside the lower conveyance belt 201.

The upper conveyance belt 206 is trained about rollers 207 and 208 to be capable of rotating, and is supported by supporting member 209. The supporting member 209 is urged by a spring to make the upper conveyance belt 206 to be in pressure contact with the Conveyance supporting plate 204 through the lower conveyance belt 201. Booklet SA subjected to cutting processing passes through the clearance between the lower conveyance belt 201 and the upper roller 205 both of the second conveyance means 200, and is further pressed by and interposed between the lower conveyance belt 201 and upper conveyance belt 206 to be conveyed.

Booklet SA conveyed in the horizontal direction by the lower conveyance belt 201 is guided by rotating large-diameter roller 211 and by guide plate 212 arranged to be fixed to be deflected by about 90° to be in a vertical direction, and is conveyed upward. The booklet SA is further interposed by the large-diameter roller 211 and pinch roller 213 to pass through booklet ejection outlet 214 to be ejected out, and is placed on booklet placing stand 401 of booklet storing means 400 with folded portion "a" of the booklet SA facing upward and edge "b" facing downward.

The booklet storing means 400 is composed of booklet placing stand 401, movable wall member 410, partition member 420, pressure wall member 430, protection member 440 and a driving means.

The booklet placing stand 401 successively receives from booklet ejection outlet 214 a plurality of booklets SA which have been cut, and it makes booklet SA to be placed thereon with folded portion "a" of the booklet SA facing upward. The movable wall member 410 is supported to be movable in the horizontal direction while standing upright on the booklet placing stand 401, and it presses a sheet face of booklet SA placed on the booklet placing stand 401 to reciprocate between the top of the booklet placing stand 401 and the booklet ejection outlet 214 in the horizontal direction.

The movable wall member 410 usually receives booklet SA placed on the booklet placing stand 401 at the stop position which is ahead of the booklet ejection outlet 214, then, retreats to the position where the booklet ejection outlet 214 is opened each time booklet SA subjected to cutting processing is placed on the booklet placing stand 401, and returns to the stop position while pressing a sheet face of the booklet SA to stand ready, after the booklet SA finishes passing through the booklet ejection outlet 214.

Partition member 420 can move in the vertical direction that is perpendicular to the booklet placing stand 401, and when the movable wall member 410 starts retreating so that the booklet ejection outlet 214 may be opened for receiving the succeeding booklet, the partition member 420 receives, in place of movable wall member 410, the sheet face of the booklet SA placed, and in synchronization with actions of the movable wall member 410 to advance to the stop position while pressing the sheet face of the succeeding booklet SA, the partition member 420 starts descending along the rear end portion of the booklet placing stand 401 to stand ready so that succeeding booklet SA may be received on the booklet placing stand 401. The partition member 420 starts ascending in synchronization with completion of a movement of the movable wall member 410 to the stop position.

Pressure wall member 430 is supported in a way that it can move while standing upright on the booklet placing stand 401, and it is spring-urged. A face of the pressure wall member 430 touching a booklet faces the movable wall member 410 or the partition member 420, and it presses a sheet face of the booklet SA placed on the booklet placing stand 401 to hold it.

The booklet placing stand 401 and the pressure wall member 430 of booklet storing means 400 are constructed to be protruded out of a main body of the booklet storing means 400.

Since a booklet conveyance path of the booklet storing means 400 is connected to a booklet ejection section located at the lowest portion of sheet finisher FS, the booklet placing stand 401 connected to a horizontal conveyance path of sheet cutter B is also arranged at a lower position on the floor.

Since the booklet placing stand 401 arranged at this lower position is hard to recognize, it is feared that a user stumbles against the booklet placing stand 401 and fall, or cause a bruise or an abrasion. It is also feared that the booklet placing stand 401 and the pressure wall member 430 are damaged.

To prevent such injuries of human bodies and damages of utensils, protection member 440 which surrounds the outer circumference of the booklet placing stand 401 is provided to be fixed on a main body of sheet cutter B. The protection member 440 is made of a stainless steel pipe or a steel pipe which is plated with glossy nickel-chromium, and is formed to be curved. Upper portion 440A of the protection member 440 is set at a height of about 650 mm from a floor. This height is in a range which is easy for a user to recognize.

Further, the protection member 440 is made of steel material having strength and a gloss so that a user can recognize the protection member 440 easily.

Though side portion 440B of the protection member 440 is almost vertical, its lower end portion is not vertical straight down to the floor and its vicinity to form bottom portion 440C which is curved toward the side wall of a main body of sheet cutter B. An end of the bottom portion 440C is fixed on the side wall of a main body of sheet cutter B.

Since space section H2 is formed under the booklet placing stand 401 and the bottom portion 440C of the protection member 440 and above the floor face, it is prevented that a foot of a user hits the bottom portion 440C of the protection member 440. The space section H2 is set to be about 200 mm.

Incidentally, the protection member 440 may also be mounted on the side wall of a main body of sheet cutter B through a buffer means.

Further, the protection member 440 is formed with pipes to be a frame which does not interfere when booklet SA placed on the booklet placing stand 401 is taken out. Incidentally, though an explanation has been given about protection member 440 that is made of pipes in the present example, it is naturally possible to make the protection member with resins or sheet metals, in addition to pipes. When making it with pipes, a weight can be reduced. When making it with resins or sheet metals, it is possible to make safety measures to be perfect by covering a booklet storing means thoroughly.

Figure 6:
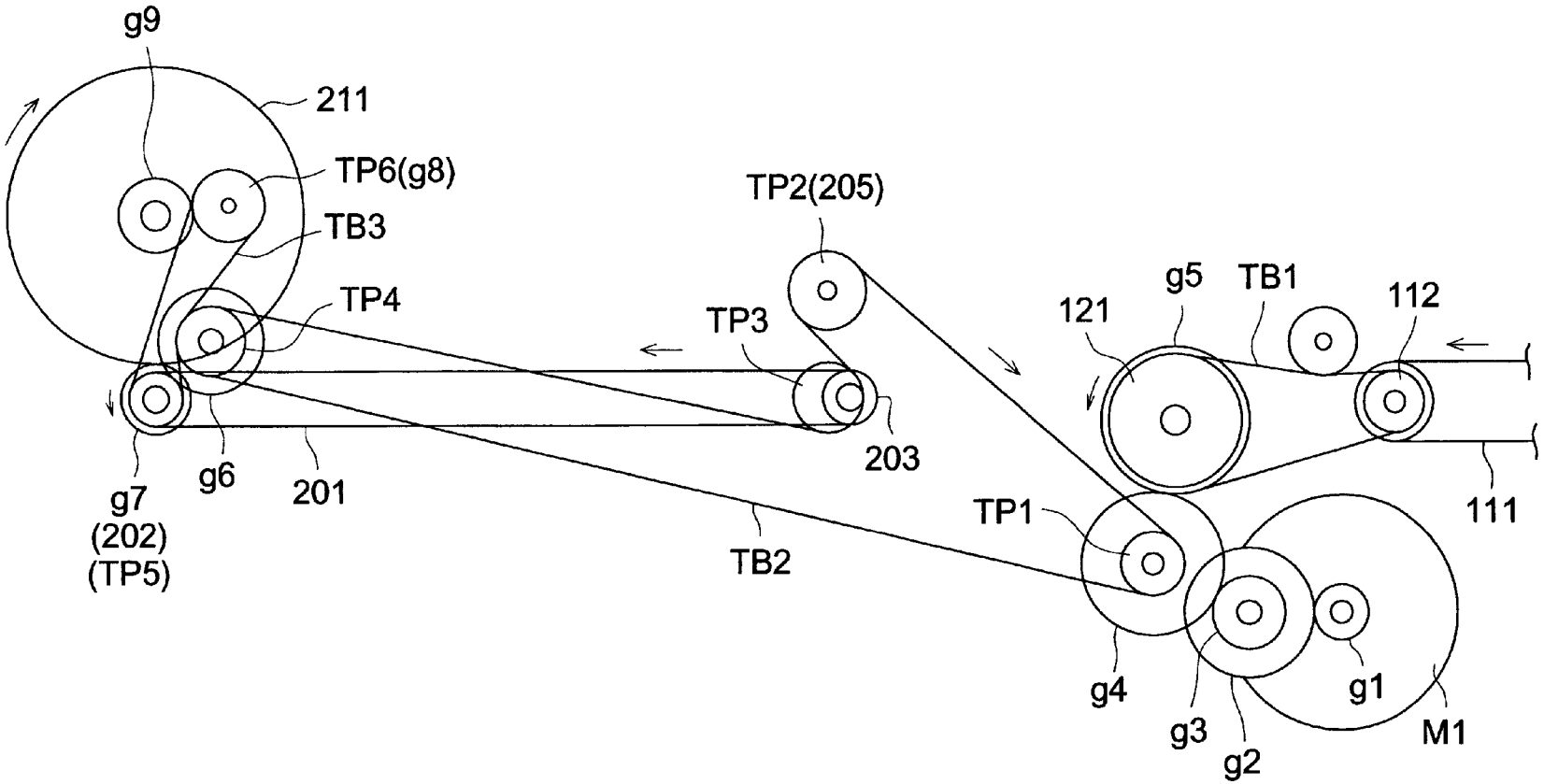
FIG. 6 is a structural diagram showing a driving means of a booklet conveyance system.

FIG. 6 is a structural diagram showing a driving means for a booklet conveyance system.

Booklet conveyance motor M1 drives first conveyance means 100 and second conveyance means 200. Gear g1 provided on the driving shaft of motor M1 rotates driving roller 121 of the first conveyance means 100 through gears g2, g3, g4 and g5. The driving roller 121 rotates driving roller 112 through belt TB1 to rotate lower conveyance belt 111.

Belt TB2 trained about pulley TP1 which shares the same axle with gear g4 coaxially is trained about pulleys TP2, TP3 and TP4 to be able to rotate. On the rotary shaft of pulley TP2, there is fixed upper roller 205 that can rotate. Gear g6 fixed on the rotary shaft of pulley TP4 rotates gear g7 that is fixed on the rotary shaft of driving roller 202. The driving roller 202 rotates lower conveyance belt 201.

Belt TB3 trained about pulley TP5 fixed on the rotary shaft of driving roller 202 and about pulley TP6 on the intermediate shaft rotates large-diameter roller 211 fixed on the rotary shaft of gear g9 through gear 8 and gear g9 fixed on the rotary shaft of the pulley TP6.

Figure 7:
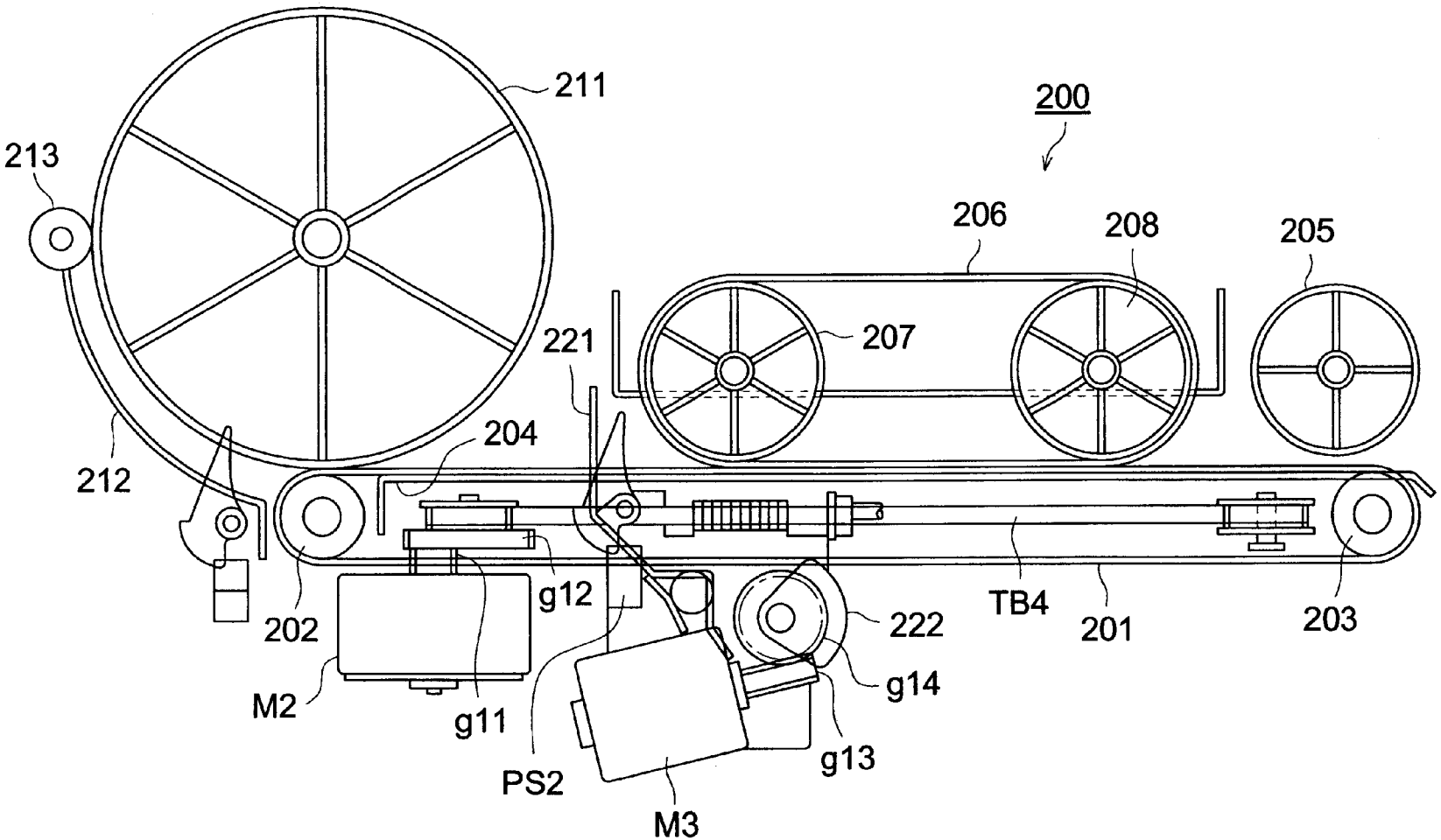
FIG. 7 is a sectional view showing a lower conveyance belt of a second conveyance means and a driving means for a movable stopper.

FIG. 7 is a sectional view showing a driving means for lower conveyance belt 201 of second conveyance means 200 and movable stopper 221.

Stopper moving motor M2 moves movable stopper 221 to the prescribed position corresponding to a sheet size through gears g11 and g12 and belt TB4. Stopper releasing motor M3 drives cam 222 to rotate through gears g13 and g14 and raises up the movable stopper 221 or brings it down. The movable stopper 221 is kept to be standing upright in the initial state when it is hit by a tip portion of booklet SA, while when booklet SA is ejected, the movable stopper is driven by motor M3 to be brought down.

Since an amount of protrusion of an edge before cutting of a booklet is varied depending on a thickness of booklet SA, namely, on a thickness of a single sheet and the number of sheets in a bundle of sheets, an optimum value for the position for the movable stopper 221 to be set is selected by the controller based on the numerals set and on detection of a thickness of the booklet.

Figure 8:
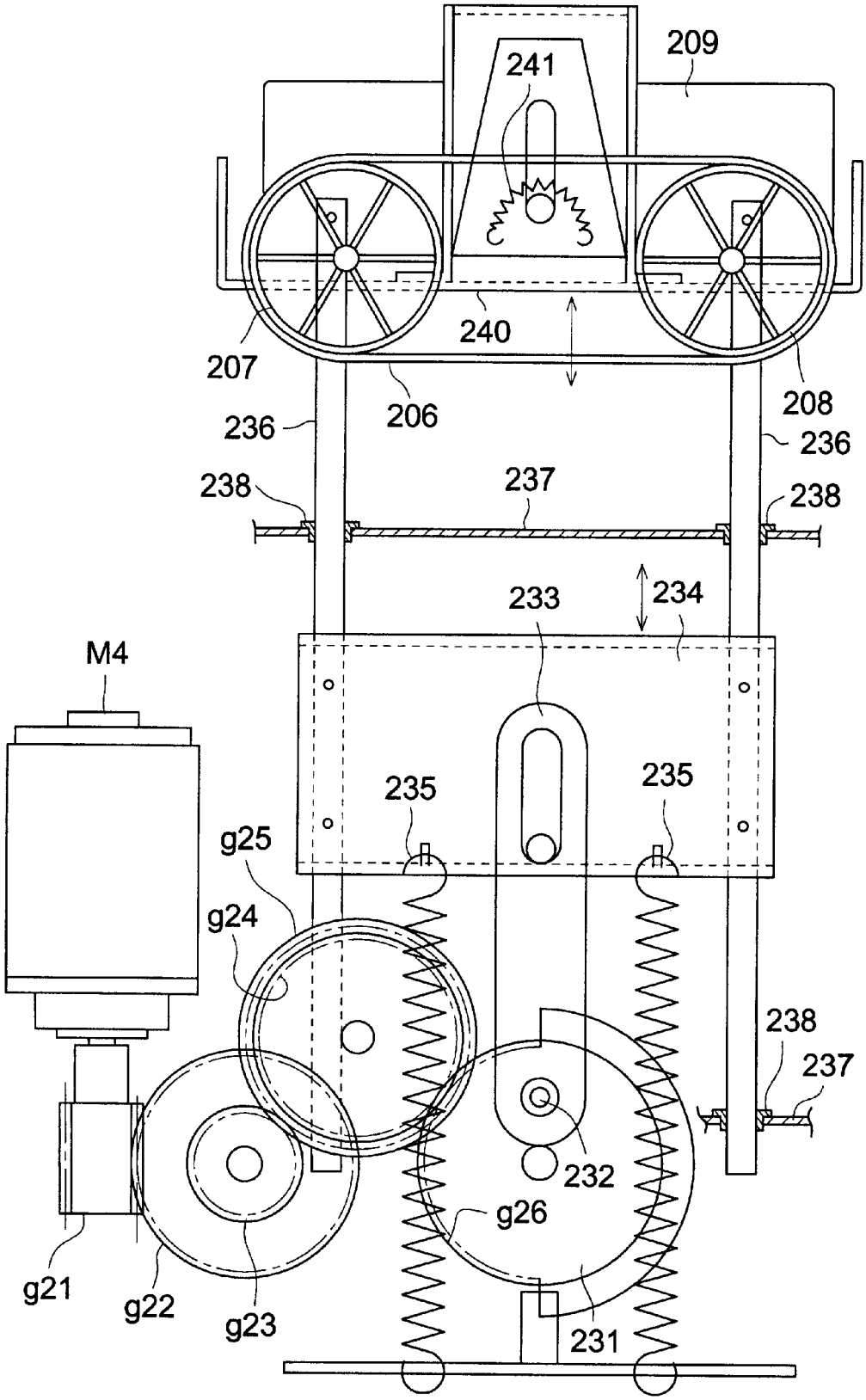
FIG. 8 is a front view of a driving means for a pressure unit including an upper conveyance belt.

FIG. 8 is a front view of a driving means for a pressure unit including upper conveyance belt 206. Pressing motor M4 rotates rotary disk 231 through gears g21, g22, g23, g24, g25 and g26. Eccentric pin 232 embedded in the rotary disk 231 is connected to the lower end portion of crank 233 so that the crank 233 is swung. An upper end portion of the crank 233 is connected to coupling plate 234 so that the coupling plate 234 is made to ascend and descend. The coupling plate 234 is urged downward by spring 235 as illustrated.

Two coupling rods 236 fixed respectively on both sides of the coupling plate 234 are engaged respectively with bearings 238 which are fixed on fixed frame body 237 to be supported to be capable of ascending and descending. An upper end portion of the coupling rod 236 is fixed on pressure plate 240.

The pressure plate 240 is spring-urged against supporting member 209 that supports upper conveyance belt 206, and is supported to be capable of ascending and descending. When cutting an edge of booklet SA placed on the surface of lower conveyance belt 201, the pressure plate 240 is made by rotation of the rotary disk 231 to ascend and descend through crank 233 and coupling plates 234 and 236. Further, the pressure plate 240 moves depending on a thickness of booklet SA, and presses an upper face of the booklet SA.

Rollers 207 and 208 are united integrally with the pressure plate 240 through spring 241. Upper conveyance belt 206 trained about the rollers 207 and 208 is urged downward by spring 241. Incidentally, a pressing force transmission system covering from the rotary disk 231 to the upper conveyance belt 206 is provided on each of this side and back side in the drawing.

Figure 9:
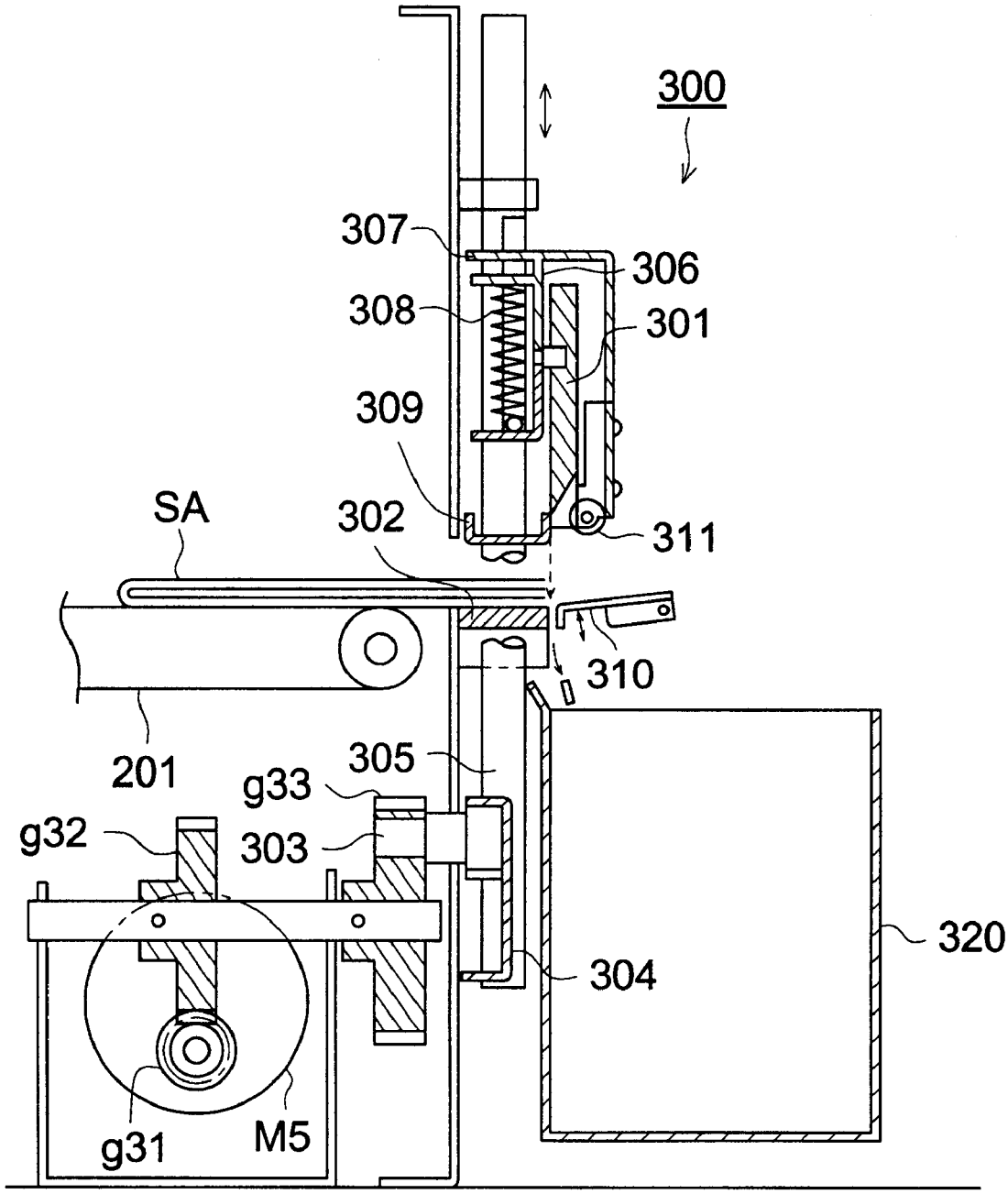
FIG. 9 is a sectional view of a cutting means.

FIG. 9 is a sectional view of cutting means 300.

The cutting means 300 is composed of upper cutting blade 301, lower cutting blade 302 and a driving means that drives the upper cutting blade 301 to be capable of ascending and descending.

Cutting motor M5 rotates gears g31, g32 and g33, and eccentrically rotates eccentric pin 303 embedded at the eccentric position on the gear g33. A tip portion of the eccentric pin 303 slides on an inner circumferential surface of movable member 304 to make it to ascend and descend.

On the upper portion of ascending/descending shaft 305 that is united integrally with the movable member 304 and is supported to be capable of ascending and descending, there is fixed upper-blade supporting frame body 306. On the upper-blade supporting frame body 306, there is fixed upper cutting blade 301.

An edge of booklet SA is cut by a blade edge of descending upper cutting blade 301 and by a blade edge of lower cutting blade 302 that is kept at the fixed position. The numeral 320 represents a wastebasket that stores waste generated from cutting of an edge.

On the upper-blade supporting frame body 306, there is supported pressure plate 309 which is urged by spring 308. On the lower portion of the upper-blade supporting frame body 306, there is supported pressure roller 311 that presses movable plate 310.

In the course of descending of the upper-blade supporting frame body 306, the pressure plate 309 descends to press the upper face of booklet SA placed on the lower cutting blade 302, and then, descending pressure roller 311 presses movable plate 310 and an edge of the upper cutting blade 301 cuts edge b.

Figure 10:
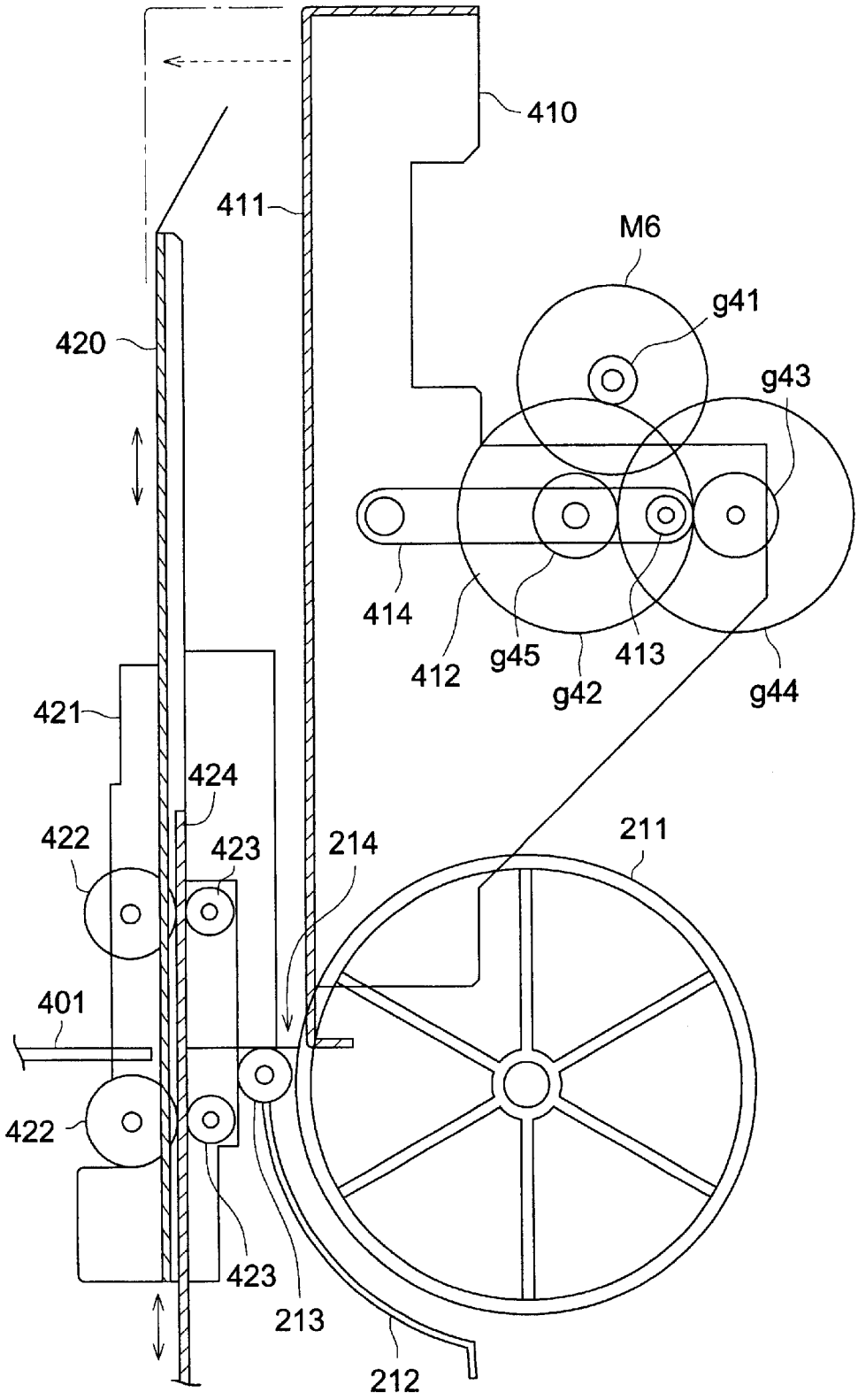
FIG. 10 is a sectional view showing a movable wall member and a partition member in the vicinity of a booklet ejection outlet.

FIG. 10 is a sectional view showing movable wall member 410 located in the vicinity of booklet ejection outlet 214 and partition member 420.

The movable wall member 410 has vertical wall section 411 that is standing upright to press the placed booklet SA, and it can move horizontally in the direction of booklet placing stand 401. Motor M6 rotates rotary disk 412 through gears g41, g42, g43, g44 and g45. Eccentric pin 413 embedded at the eccentric position of the rotary disk 412 is connected with the right end portion of crank 414 to swing the crank 414. The illustrated left end portion of the crank 414 is connected with movable wall member 410 to move the movable wall member 410 in the horizontal direction. The movable wall member 410 shown with solid lines in the illustration shows its retreat position, and it is the state wherein the booklet ejection outlet 214 is opened to make it possible for booklet SA to pass. The position shown with one-dot chain lines is a stop position to which the movable wall member 410 has been moved in the horizontal direction by a driving means.

Movable supporting member 421 arranged on both side end portions of partition member 420 that is arranged to be in parallel with and to be in the vicinity of the movable wall member 410 supports two sets of paired rollers 422 and 423 in a way that these rollers can rotate. The two sets of paired rollers 422 and 423 roll on guide rail 424 arranged on each of both sides of an apparatus main body to make it possible for the movable supporting member 421 to ascend and descend.

Namely, the movable supporting member 421 is driven to ascend and descend along guide rail 424 by motor M7 that is provided on the lower portion of the guide rail 424 and is not illustrated and by a driving means. The illustrated partition member 420 ascends from the lower retreat position, and shows the state where booklet SA can be supported.

Figure 11:
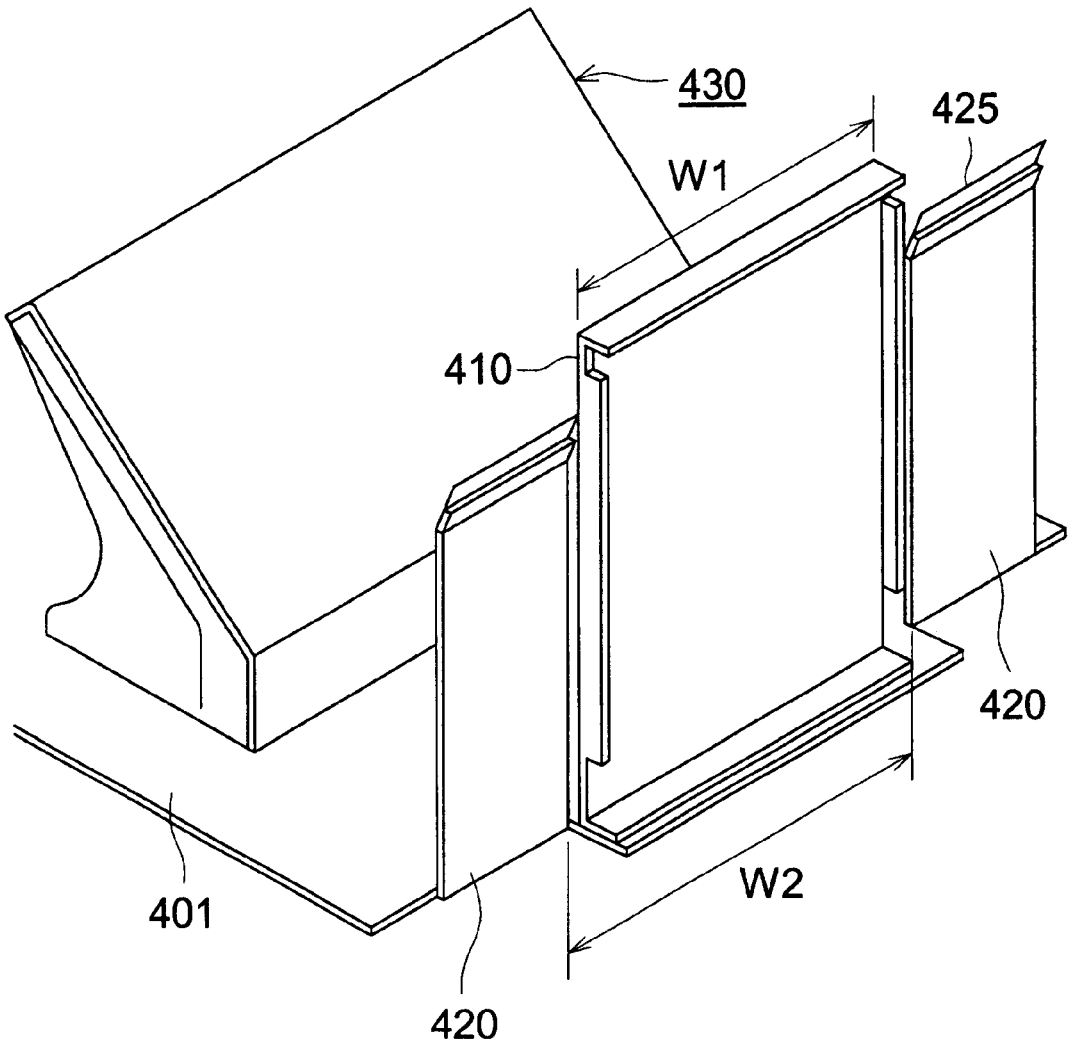
FIG. 11 is a perspective view of a movable wall member, a partition member and a pressure wall member.

FIG. 11 is a perspective view for movable wall member 410, partition member 420 and pressure wall member 430. Since outer dimension W1 of the movable wall member 410 in the lateral direction of a booklet is established to be smaller than inner dimension W2 of the partition member 420 arranged outside the movable wall member 410 in the lateral direction of a booklet, the movable wall member 410 does not interfere with the partition member 420.

Thin layer 425 made of resin which is provided on the upper portion of the partition member 420 and can deform elastically prevents a clash between the lower portion of the placed booklet and the partition member 420 both located at both end portions of the movable wall member 410 that is caused when the partition member 420 ascends.

Figure 12:
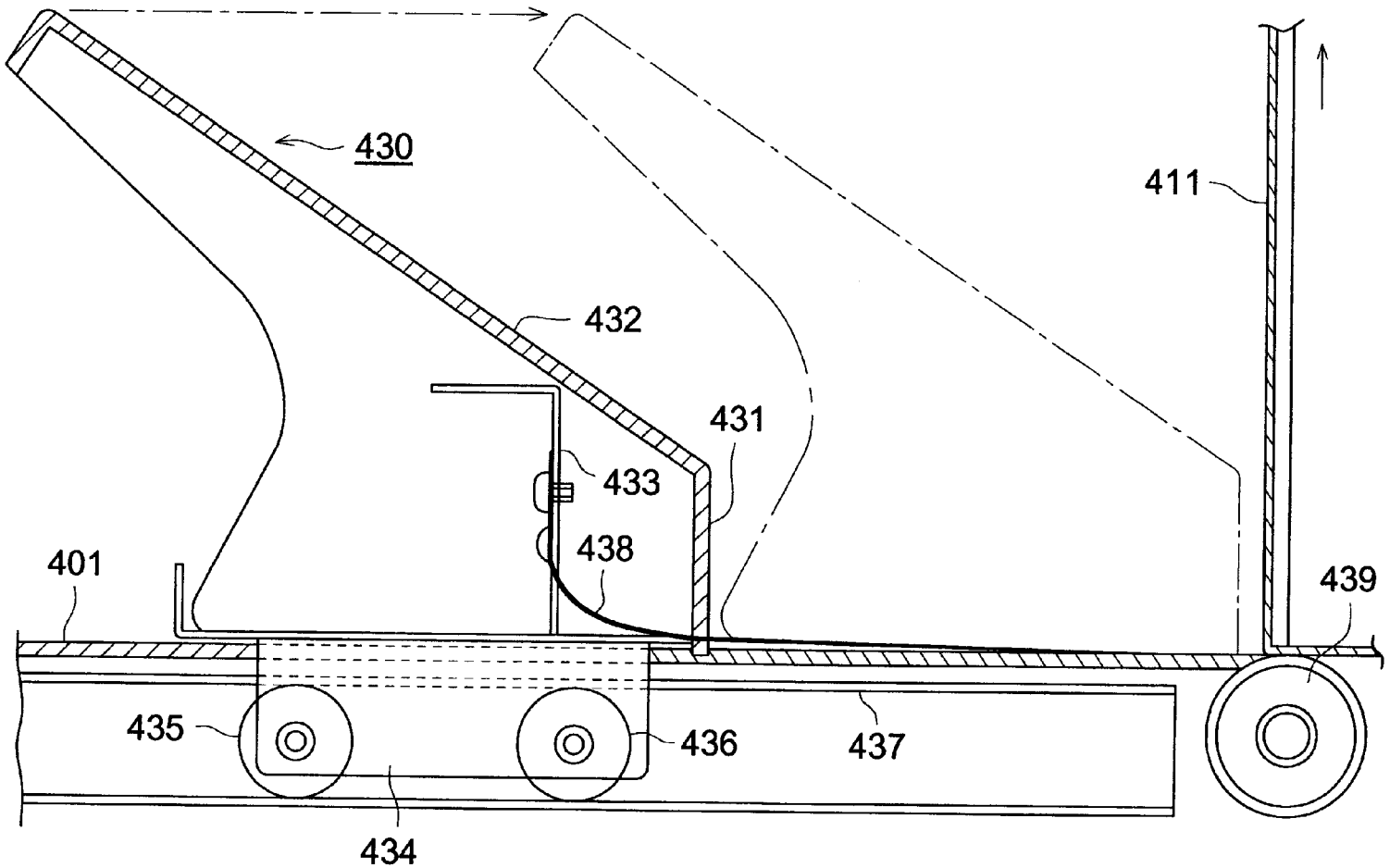
FIG. 12 is a sectional view showing a booklet stand and a pressure wall member of a booklet storing means.

FIG. 12 is a sectional view showing booklet placing stand 401 of booklet storing means 400 and pressure wall member 430.

The pressure wall member 430 is composed of vertical pressure wall surface section 431, inclined surface section 432 having an inclination angle, spring-hooking section 433 and roller-attaching section 434. The pressure wall surface section 431 presses the lower portion of booklet SA that is placed, with its folded section "a" facing upward, on booklet placing stand 401 A length of the pressure wall surface section 431 in the vertical direction is set to a half of the minimum length of booklet SA in its height direction or less. Inclined surface section 432 that is connected with the upper portion of the pressure wall surface section 431 checks falling of the upper portion of booklet SA.

Roller-attaching section 434 located on the bottom portion of the pressure wall member 430 supports rollers 435 and 436 so that the rollers may rotate. The rollers 435 and 436 roll along a parallel face of guide member 437 arranged under booklet placing stand 401 to be in parallel with it and makes the pressure wall member 430 to move straight.

The other end of constant force spring member 438 whose one end is fixed on spring-hooking section 433 is wound round spring take-up member 439 to be fixed. The constant force spring member 438 is one wherein a leaf spring having elasticity is wound to be in a coil spring, and its tensile force pulls pressure wall member 430 toward the movable wall member 410 to interpose booklet SA.

As another embodiment of the pressure wall member 430, it is also possible to arrange so that inclined surface section 432 is supported to be capable of swinging and is further urged by a spring so that a swelling of a folded portion of the booklet is pressed to be compressed.

A process of storing booklet SA will be shown below. Each of FIGS. 13(*a*)–13(*r*) is a time chart showing a process of storing booklet SA in booklet storing means 400. Each of FIGS. 14–17 is a sectional view showing how booklet SA is placed on booklet storing means 400.

(1) FIG. 14 is a sectional view showing the initial stage where booklet SA is not stored in booklet storing means 400 yet. In this initial stage, movable wall member 410 advances and is stopped at the position where booklet ejection outlet 214 is closed, and partition member 420 is stopped at the position to which the partition member 420 has ascended. The lower portion of the preceding booklet SA1 is interposed between vertical wall section 411 of the movable wall member 410 and pressure wall surface section 431 of pressure wall member 430. An upper double-folded portion of booklet SA1 has a swelling and has been brought down to inclined surface section 432 of the pressure wall member 430 by its own weight to be placed.

(2) After the lapse of prescribed period of time from processing of cutting an edge of booklet SA, the movable wall member 410 is driven by motor M6 to retreat, and it stops at the position where booklet ejection outlet 214 is opened, so that succeeding booklet SA2 may be received. While partition member 420 is staying at the upper portion of the initial position, it interposes booklet SA1 in place of movable wall member 410 (see FIG. 15).

(3) After the succeeding booklet SA2 has been fed out of the booklet ejection outlet 214 so that the lower end portion of the succeeding booklet SA2 passes through the position of interposing between large-diameter roller 211 and pinch roller 213, the movable wall member 410 starts advancing. The movable wall member 410 advances to press booklet SA2 and to push it toward partition member 420. Almost simultaneously with the start of advancing of the movable wall member 410, motor M7 starts driving the partition member 420 to start descending (see FIG. 16).

(4) When the partition member 420 descends and retreats to stop at the position that is lower than booklet placing stand 401, booklet SA2 is pressed by advancing movable wall member 410 and is placed to be superposed on preceding booklet SA1 (see FIG. 17).

(5) When the movable wall member 410 advances and arrives at the stop position to stop, booklets SA1 and SA2 are interposed between the movable wall member 410 and spring-urged pressure wall member 430. After that, partition member 420 ascends and arrives at the initial position on the rear side of the movable wall member 410 to stop (see FIGS. 14 and 18).

FIG. 18 is a sectional view showing booklet storing means 400 wherein a plurality of booklets SA are placed on booklet placing stand 401.

The lower portion of booklet SA is interposed closely to be standing upright between the movable wall member 410 and spring-urged pressure wall member 430. The upper portion of booklet SA having a folded portion and a swelling is superposed on a space section spread upward on inclined surface section 432 of pressure wall member 430 so that the booklet SA is placed. After booklets have been placed, or in the course of placing booklets, it is possible to take out booklet SA easily by picking an upper portion of the booklet SA.

FIG. 19 is a sectional view of second conveyance means 200 and cutting means 300, in which an edge of booklet SA is cut.

Motor M4 starts driving supporting member 209 to descend, and thereby, pressure plate 240 presses the surface of the upper portion of booklet SA, and booklet SA is flattened by urging force of sprint 235. Upper conveyance belt 206 urged by spring 241 is also brought into pressure contact with the surface of the upper portion of booklet SA to move relatively to pressure plate 240.

Almost in synchronization with the foregoing, motor M5 starts driving pressure plate 309 to descend, to press the neighborhood of an edge of booklet SA.

Driving roller 121 arranged at the upstream side of cutting means 300 in the booklet conveyance direction is supported rotatably at the prescribed position of a booklet conveyance path, and is driven by motor M1 to rotate. A rotary shaft of driven roller 122 which is brought into pressure contact with driving roller 121 by its own weight or is urged by spring to be brought into pressure contact with driving roller 121 is supported to be capable of moving upward in the vertical direction perpendicular to the sheet conveyance path. With regard to an amount of clearance of the driven roller 122, a clearance through which a fingertip cannot pass is the largest at the utmost, and maximum clearance X1 between an outer circumferential surface of driving roller 121 and that of driven roller 122 is set to about 8 mm.

Both of lower conveyance belt 201 arranged at the downstream side of cutting means 300 in the booklet conveyance direction and upper roller 205 supported rotatably at the prescribed position above a booklet conveyance path are driven by motor M1 to rotate. The maximum clearance between an upper surface of lower conveyance belt 201 and an outer circumferential surface of upper roller 205 is one through which a fingertip cannot pass, and maximum clearance X2 is set to about 8 mm.

Distance Y1 from the position of interposing between driving roller 121 and driven roller 122 to the position where cutting means 300 cuts an edge of a booklet is set to about 15 mm or more. This distance Y1 is one through which a tip portion of a finger or a fingernail does not reach upper cutting blade 301 and lower cutting blade 302 of cutting means 300 even when a finger is inserted by force from the maximum clearance X1.

Distance Y2 from the position where lower conveyance belt 201 comes close to upper roller 205 to the position where an edge of a booklet is cut by cutting means 300 is set to about 15 mm or more. This distance Y2 is one through which a tip portion of a finger or a fingernail does not reach upper cutting blade 301 and lower cutting blade 302 of cutting means 300 even when a finger is inserted by force from the maximum clearance X2.

FIG. 20 is a sectional view of supporting member 209 that supports upper conveyance belt 206 and pressure plate 240.

An operational back side of supporting member 209 is connected, to be capable of swinging to open and close, with supporting shaft 242 connected to connecting rod 236A on the back side. An operational this side of the supporting member 209 is connected, to be capable of swinging, with supporting shaft 243 connected to connecting rod 236B on this side. On the supporting shaft 243, there is supported locking claw member 244 which locks the supporting member 209 when it is closed. The numeral 245 represents a pin that positions the supporting member 209, while, 246 represents a spring that urges the supporting member 209 to be capable of being opened.

One-dot chain lines illustrated show the state wherein locking of the supporting member 209 is released to make it swing around supporting shaft 242 to open a space above a conveyance path for booklet SA. If the locking claw member 244 is captured for releasing, supporting member 209 that supports upper conveyance belt 206 and pressure plate 240 is urged by spring 246 to create the open state. Under this open state, booklet SA conveyed defectively and is staying on lower conveyance belt 201 can easily be taken out.

Each of FIGS. 21(*a*)–21(*d*) is an illustration showing the process to cut edge b of booklet SA with sheet cutter B. FIG. 22 is a block diagram showing the control of sheet cutter B.

An edge cutting process for booklet SA will be shown below.

(1) There are inputted setting signals for conducting edge cutting processing for booklet SA which has been subjected to center-folding processing and center-stapling processing by sheet finisher FS.

(2) When sheet size detection signal by image forming apparatus main body A or by sheet finisher FS, or sheet size signal to be set on an operation section of the image forming apparatus main body A is inputted in sheet cutter B, a unit including movable stopper 221 is driven by motor M2 to move to stop at the sheet size position established.

(3) Center-stapled and center-folded booklet SA ejected out of sheet finisher FS is fed into first conveyance means 100 of sheet cutter B and is further fed into second conveyance means 200.

(4) Booklet SA which has been conveyed into the second conveyance means 200 is conveyed through the space of prescribed clearance (for example, 8 mm) where rotating lower conveyance belt 201 and upper roller 205 that rotates at the fixed position face each other, in a way that a swelling of the folded portion of the booklet SA is squeezed. When sensor PS2 arranged in the vicinity of movable stopper 221 detects passage of the leading edge of the booklet SA, control means 90 controls rotation of the lower conveyance belt 201 to stop it so that the leading edge of the booklet SA may come in contact with movable stopper 221 to stop (see FIG. 21(*a*)).

(5) After the detection of passage of the leading edge of booklet SA conducted by the sensor PS2, motor M4 is started by control means 90 to drive pressure plate 240 to descend. The pressure plate 240 descends, and presses strongly the upper surface in the vicinity of the leading edge (folded portion "a") of the booklet SA. In addition, upper conveyance belt 206 urged by spring 241 also descends and presses the upper surface in the vicinity of the leading edge of the booklet SA. Swelling of the center-stapled and center-folded booklet SA shown in FIG. 21(*a*) is compressed to be flattened (FIG. 21(*b*)) by the pressing forces mentioned above.

(6) Then, after lapse of a prescribed period of time, the control means 90 starts driving motor M5, and thereby, pressure plate 309 first presses an upper surface of booklet SA to correct a warp on the edge portion of booklet SA for its close contact, and then, upper cutting blade 301 descends to cut edge b of booklet SA (FIG. 21(*c*)).

(7) After the edge is cut, motor M5 that keeps running makes the upper cutting blade 301 and pressure plate 309 to ascend. The motor M keeps running and it stops running when the upper limit of the upper cutting blade 301 is detected by the sensor.

With a signal of detection of upper limit of the upper cutting blade 301, the control means 90 makes motors M4 and M3 to start driving. Motor M4 drives pressure plate 240 and upper conveyance belt 206 to ascend. Motor M3 drives movable stopper 221 to be brought down so that a tip portion of the movable stopper is embedded to be lower than a conveyance surface for booklet SA and a sheet ejection path is opened.

After that, motor M1 is driven to make lower conveyance belt 201 to rotate to convey booklet SA and to eject it toward booklet ejection outlet 214 (FIG. 21(*d*)).

(8) After booklet SA is interposed by large-diameter roller 211 and by pinch roller 213 to be ejected upward vertically and the trailing edge of the booklet SA is placed on booklet placing stand 401, the booklet SA is placed in a standing posture with its folded portion "a" facing upward, while being interposed by movable wall member 410, partition member 420 and pressure wall member 430 (see FIG. 4).

As stated above, a sheet cutter and a sheet finisher of the invention make it possible to obtain the following effects.

(1) Since it is possible, in the cutter of the invention, to place booklets SA on a booklet placing stand of a booklet storing means that stores a plurality of cut booklets, in a standing posture with their folded portions "a" facing upward and with sheet faces superposed each other, it is possible to place a large number of booklets on the booklet storing means. It is further possible to reduce a floor space for the booklet storing means. In addition, booklets can be put in order in a regular manner without slipping down of booklets which has been observed in a conventional system for horizontal stacking of booklets.

(2) By making the cut booklet to be deflected upward vertically from the cutting section conveyance path by the use of a large-diameter roller, a pinch roller and a guide plate, and thereby, by conveying the booklet to a booklet storing means, it is possible to convey the booklet smoothly to a booklet ejection section, which is effective for reducing a floor space for the booklet storing means.

(3) Due to the sheet cutter of the invention wherein a movable wall member accepts a booklet placed at a stop position where a booklet ejection outlet is usually closed on the booklet placing stand, then, it retreats to the position where the booklet ejection outlet is opened each time the cut booklet is conveyed into the booklet placing stand, and the movable wall member returns to the stop position while pressing the sheet face of the booklet after the booklet finishes passing the booklet ejection outlet, to stand ready, it is possible to improve a vertical stacking efficiency for booklets and to store a large number of booklets in a regular manner.

(4) Due to cooperative operations of a movable wall member and a partition member, it is possible to store smoothly a preceding booklet placed on a booklet placing stand and a succeeding booklet to be conveyed onto the booklet placing stand, by delivering and transferring the booklet.

(5) By providing, on the pressure wall member, a coil-shaped constant force spring member in which a long leaf spring for spring-urging is wound, it is possible for the pressure wall member to put booklets in order by pressing the sheet face with uniform pressing force independently of the number of sets of booklets placed on a booklet placing stand.

(6) The pressure wall member composed of a pressure wall surface section that presses a sheet face and an inclined surface section opened upward can store a large number of booklets stably on a stacking basis by interposing closely the lower portion of the booklet in the standing posture with a pressure wall surface section and by holding a swelling on the upper portion of the booklet gently with the inclined surface section.

(7) A sheet on which an image is formed by an image forming apparatus such as a copying machine, a printer or a hybrid machine including the copying machine and the printer is subjected to center-stapling processing and center-folding processing conducted by a sheet finisher, then, an edge of the sheet is trued up evenly by a cutting means of a cutter, and the sheet turns into a book-bound booklet, and a large number of the booklets can be stacked stably on the booklet storing means.

(8) By arranging a driving means of the pressing means below the booklet conveyance path and by swinging the pressing means to make it to be opened and closed in the cutter for cutting, after a swelling in the vicinity of a folded portion of the booklet subjected to center-stapling processing and center-folding processing is pressed by a pressing means to be removed and flattened, it is possible to make the space above the booklet conveyance path to be opened broadly so that the booklet in the defective conveyance may be taken out easily and safely.

(9) By making fine adjustment of the position of a movable stopper that positions an edge portion of a booklet in accordance with the number of sheets to be folded and a thickness thereof, the control means for the sheet cutter of the invention makes it possible to cut properly neither too much nor too less with an appropriate amount of cutting, thus, an edge of the booklet can be trued up evenly, and quality of finish of the book-bound booklet is improved.

(10) With regard to a sheet which is ejected out after processing such as desired digital processing, single-sided recording, two-sided recording and re-editing are conducted by an image forming apparatus such as a copying machine, a printer or a hybrid machine including the copying machine and the printer, edge cutting of the sheet is accurately conducted by the sheet cutter of the invention, and the sheet turns into a book-bound booklet, thus, a continuous and stable processing to finish booklets is attained.

(11) By providing booklet conveyance means respectively on the upstream side and the downstream side of the conveyance path for a booklet which passes through the gap between an upper cutting blade and a lower cutting blade both constituting a cutting means, it is prevented that a fingertip of a user is accidentally brought into contact with a sharp upper cutting blade and lower cutting blade of a cutting means to be injured.

(12) By arranging a protection member that is fixed on a sheet cutter main body to surround an outer circumference of a booklet placing stand of a booklet storing means, it is prevented that a user stumbles against the booklet placing stand to fall down or to damage the booklet placing stand.

(13) By securing a prescribed space section between the bottom portion of an ascending and descending sheet ejection tray that has arrived at its lower limit position and an upper portion of a casing outer wall that is in the vicinity of the conveyance means inlet section of the sheet cutter, it is prevented that a hand of a user is accidentally caught by the gap between the descending ascending and descending sheet ejection tray and the upper portion of the casing outer wall to be injured, or an object is caught to cause damage and troubles.

What is claimed is:

1. A sheet cutter for finishing a booklet, comprising:

(a) a cutting means for cutting edges of a bundle of sheets folded double;

(b) a booklet storing means having a booklet stand for storing a plurality of booklets each whose edges have been cut by the cutting means, wherein the plurality of booklets are stacked on the booklet stand while sheet faces of the booklets are overlapped one another with a folded portion of each booklet facing upward;

(c) a movable wall member for pressing the sheet face of the booklet supported to stand upright on the booklet stand and reciprocating between a topside of the booklet stand and a booklet ejection opening; and (d) a driving means for making the movable wall member to reciprocate.

2. The sheet cutter of claim 1, wherein the cutting means comprises an upper cutting blade and a lower cutting blade for cutting edges of each booklet, the sheet cutter further comprising rotating members for conveyance of the booklet provided in the vicinity of each of an upstream side and a downstream side in a conveyance direction for the booklet for preventing from being brought into contact with the upper cutting blade and the lower cutting blade.

3. The sheet cutter of claim 2, wherein the rotating member on the upstream side comprises a rotary driving conveyance roller and a follower roller capable of being in pressure contact with and separating from the conveyance roller.

4. The sheet cutter of claim 3, wherein a maximum gap between an outer circumferential surface of the conveyance roller and an outer circumferential surface of the follower roller is secured in a dimension into which a fingertip of an operator cannot be inserted.

5. The sheet cutter of claim 2, wherein the rotating member on the downstream side comprises a lower conveyance belt and an upper roller provided above the lower conveyance belt while maintaining a predetermined gap therebetween.

6. The sheet cutter of claim 5, wherein a maximum gap between an outer circumferential surface of the lower conveyance belt and an outer circumferential surface of the upper roller is secured in a dimension into which a fingertip of an operator cannot be inserted.

7. The sheet cutter of claim 1 further comprising a protection member that is formed to surround an outer circumference of the booklet storing means and is fixed on a main body of the sheet cutter.

8. A sheet cutter for finishing a booklet, comprising:

(a) a cutting means for cutting edges of a bundle of sheets folded double;

(b) a conveyance means provided in a cutting section for conveying the booklet whose edges have been cut by the cutting means;

(c) a rotatable roller with a large diameter provided downstream in a sheet conveyance direction of the cutting means, for deflecting the booklet to a vertical direction from the conveyance means to convey to a booklet storing means; said booklet storing means having a booklet stand for storing a plurality of booklets each whose edges have been cut by the cutting means;

(d) a pinch roller for pressing the booklet against the rotatable roller to convey the booklet and for following the rotatable roller to rotate;

(e) a guide plate for deflecting the booklet to the vertical direction from the conveyance means to guide the booklet to an interposing position between the rotatable roller and the pinch roller;

(f) a movable wall member for pressing the booklet supported to stand upright on the booklet stand and reciprocating between a topside of the booklet stand and a booklet ejection opening; and (g) a driving means for making the movable wall member to reciprocate.

9. The sheet cutter of claim 8, wherein a stacking surface of the booklet storing means for stacking the booklets is disposed upward by a length corresponding substantially to a radius of the rotatable roller from the conveyance means in the cutting section.

10. The sheet cutter of claim 8 wherein the booklet stand on which each of booklets whose edges have been cut by the cutting means is stacked by the rotatable roller, the pinch roller and the guide plate so that sheet faces of the booklets are overlapped one another with a folded portion of each booklet facing upward.

11. A sheet cutter for finishing a booklet, comprising:

(a) a cutting means for cutting edges of a bundle of sheets folded double;

(b) a booklet ejection opening;

(c) a booklet storing means having a booklet stand for accepting a plurality of booklets each whose edges have been cut by the cutting means, which has passed through the booklet ejection opening so that the booklets are stacked while sheet faces of the booklets are overlapped one another with a folded portion of each booklet facing upward;

(d) a movable wall member for pressing the sheet face of the booklet supported to stand upright on the booklet stand and reciprocating between a topside of the booklet stand and the booklet ejection opening; and (e) a driving means for making the movable wall member to reciprocate, wherein the movable wall member accepts the booklet that is usually stacked at a stop position on the booklet stand, then, retreats to a rear position of the booklet ejection opening each time the booklet whose edges have been cut is conveyed to the booklet stand, and returns to the stop position while pressing the sheet face of the booklet to stand ready after the booklet finishes passing through the booklet ejection opening.

12. The sheet cutter of claim 11, wherein a width of a pressing surface section of the movable wall member against the booklet is formed narrower than a booklet width of a minimum size of the booklets stacked on the booklet stand.

13. The sheet cutter of claim 11, wherein the booklet ejection opening comprising:

a rotatable roller with a large diameter provided downstream in a sheet conveyance direction of the cutting means, for deflecting the booklet to a vertical direction from the conveyance means to convey;

a pinch roller for pressing the booklet against the rotatable roller to convey and for following the rotatable roller to rotate; and a guide plate for deflecting the booklet to the vertical direction from the conveyance means to guide the booklet to an interposing position between the rotatable roller and the pinch roller.

14. A sheet cutter for finishing a booklet, comprising:

(a) a cutting means for cutting edges of a bundle of sheets folded double;

(b) a booklet ejection opening;

(c) a booklet storing means having a booklet stand for accepting a plurality of booklets each whose edges have been cut by the cutting means, which has passed through the booklet ejection opening so that the booklets are stacked while sheet faces of the booklets are overlapped one another with a folded portion of each booklet facing upward;

(d) a movable wall member for pressing the sheet face of the booklet supported to stand upright on the booklet stand and reciprocating between a topside of the booklet stand and the booklet ejection opening;

(e) a partition member provided to face the sheet face on the movable wall member and to be capable of moving in a direction perpendicular to the booklet stand; and (f) a driving means for making the movable wall member and the partition member to reciprocate, wherein the movable wall member accepts the booklet that is usually loaded at a stop position on the booklet stand, then, retreats to a rear position of the booklet ejection opening each time a booklet whose edges have been cut is conveyed to the booklet stand, and before the movable wall member retreats for accepting the booklet and the booklet ejection opening is opened, the partition member moves to a position where an end portion of the booklet is accepted in place of the movable wall member, and when the movable wall member moves to the stop position while pressing the sheet face of the booklet, the partition member starts moving to retreat so that the booklet stand can accept the booklet.

15. The sheet cutter of claim 14, wherein the booklet ejection opening comprising:

a rotatable roller with a large diameter provided downstream in a sheet conveyance direction of the cutting means, for deflecting the booklet to a vertical direction from a conveyance means provided in a cutting section to convey;

a pinch roller for pressing the booklet against the rotatable roller to convey and for following the rotatable roller to rotate; and a guide plate for deflecting the booklet to the vertical direction from the conveyance means to guide the booklet to an interposing position between the rotatable roller and the pinch roller.

16. A sheet cutter for finishing a booklet, comprising:

(a) a cutting means for cutting edges of a bundle of sheets folded double;

(b) a booklet storing means having a booklet stand on which a plurality of booklets each whose edges have been cut by the cutting means are accepted while sheet faces of the booklets are overlapped one another with a folded portion of each booklet facing upward;

(c) a movable pressure wall member that is supported to stand upright on the booklet stand, for pressing the sheet face of the booklet stacked on the booklet stand;

(d) a coil-shaped constant load spring member composed of a long leaf spring that is coiled to urge the pressure wall member;

(e) a movable wall member for pressing the sheet face of the booklet supported to stand upright on the booklet stand and reciprocating between a topside of the booklet stand and a booklet ejection opening; and (f) a driving means for making the movable wall member to reciprocate.

17. The sheet cutting of claim 16 further comprising:

a partition member provided to face the sheet face on the movable wall member and to be capable of moving in a direction perpendicular to the booklet stand, wherein the pressure wall member urged by the constant load spring member faces either the movable wall member or the partition member, and presses the sheet face of the booklet to thereby pinch the booklet.

18. The sheet cutter of claim 17, wherein each of an edge portion of the booklet stacked on the booklet storing means is placed on a flat portion of the constant load spring member.

19. The sheet cutter of claim 16 further comprising:

a partition member provided to face the sheet face on the movable wall member and to be capable of moving in a direction perpendicular to the booklet stand; and a driving means for making the movable wall member and the partition member to reciprocate, wherein the movable wall member accepts the booklet that is usually loaded at a stop position on the booklet stand, then, retreats to a rear position of the booklet ejection opening each time a booklet whose edges have been cut is conveyed to the booklet stand, and before the movable wall member retreats for accepting the booklet and the booklet ejection opening is opened, the partition member moves to the position where an end portion of the booklet is accepted in place of the movable wall member, and when the movable wall member moves to the stop position while pressing the sheet face of the booklet, the partition member starts moving to retreat so that the booklet stand can accept the booklet.

20. A sheet cutter for finishing a booklet, comprising:

(a) a cutting means for cutting edges of a bundle of sheets folded double;

(b) a booklet storing means having a booklet stand on which a plurality of booklets each whose edges have been cut by the cutting means are accepted while sheet faces of the booklets are overlapped one another with a folded portion of each booklet facing upward;

(c) a movable wall member that is supported to stand upright on the booklet stand, for pressing the sheet face of the booklet stacked on the booklet stand and reciprocating on the booklet stand to support the sheet face of the booklet; and (d) a movable pressure wall member that faces the movable wall member for pressing the sheet face of a booklet stacked on the booklet stand, wherein the pressure wall member comprises:

a pressure wall face section that stands upright on the booklet stand to be in parallel with a sheet supporting wall face of the opposing movable wall member for pressing the sheet face of the booklet, and an inclined surface section having an inclination angle in a direction wherein un upper part of the pressure wall face goes away from the sheet supporting wall face of the movable wall member.

21. The sheet cutter of claim 20, wherein a length of the pressure wall member in a vertical direction is not more than half a minimum length of a height of booklets supported to stand upright.

22. A sheet edge cutting method to finish a booklet by cutting edges of a booklet which has been center-stapled and folded double with a cutting means, wherein there is provided a pressing means capable of ascending and descending that presses and separates a top face of the booklet placed at a prescribed position on a conveyance member that conveys the booklet, the sheet edge cutting method comprising the steps of:

(a) pressing the booklet placed on the conveyance member by an ascending and descending means that drives the pressing means to ascend and descend so as to press and release the booklet; and (b) cutting the edges of the booklet by the cutting means thereby aligning the edges of the booklet.

23. A sheet cutter for finishing a booklet which has been folded double, comprising:

(a) a cutting means for cutting edges of the booklet;

(b) a conveyance means to convey the booklet;

(c) a pressing means capable of ascending and descending, for pressing and separating a top face of the booklet placed on the conveyance means;

(d) a ascending and descending means arranged below the conveyance means, for driving the pressing means to ascend and descend thereby to press and release the top face of the booklet; and (e) a driving means arranged below the conveyance means, for driving the ascending and descending means.

24. The sheet cutter of claim 23, wherein the pressing means comprises a rotary conveyance belt and a pressure plate which are in pressure contact with the conveyance means to follow.

25. The sheet cutter of claim 23, wherein the pressing means is supported capable of swing upward around a fulcrum provided on an operational rear side so as to be capable of opening or closing a conveyance path for the booklet.

26. The sheet cutter of claim 23 further comprising:

a booklet ejection opening;

a booklet storing means having a booklet stand for accepting a plurality of booklets each whose edges have been cut by the cutting means, which has passed through the booklet ejection opening so that the booklets are stacked while sheet faces of the booklets are overlapped one another with a folded portion of each booklet facing upward;

a movable wall member for pressing the sheet face of the booklet supported to stand upright on the booklet stand and reciprocating between a topside of the booklet stand and the booklet ejection opening; and a driving means for making the movable wall member to reciprocate, wherein the movable wall member accepts the booklet that is stacked at a stop position on the booklet stand, then, retreats to a rear position of the booklet ejection opening each time the booklet whose edges have been cut is conveyed to the booklet stand, and returns to the stop position while pressing the sheet face of the booklet to stand ready after the booklet finishes passing through the booklet ejection opening.

27. A sheet cutter for finishing a booklet which has been folded double, comprising:

(a) a sheet cutting means for cutting edges of the booklet;

(b) a conveyance means for conveying the booklet;

(c) a movable stopper movable in parallel with a conveyance direction of the booklet, for stopping the booklet at a prescribed position at which the edges of the booklet are cut by the sheet cutting means;

(d) a positioning means for positioning the movable stopper at the prescribed position in accordance with a booklet size;

(e) a control means for adjusting finely a position of the movable stopper from the prescribed position in accordance with the booklet size in accordance with the number of sheets of the booklet to be folded;

(f) a booklet storing means having a booklet stand for storing a plurality of booklets each of whose edges have been cut by the sheet cutting means;

(g) a movable wall member for pressing the sheet face of the booklet supported to stand upright on the booklet stand and reciprocating between a topside of the booklet stand and a booklet ejection opening; and (h) a driving means for making the movable wall member to reciprocate.

28. An image forming apparatus comprising:

(a) a sheet feeding means for feeding a sheet;

(b) an image forming means for forming an image on the sheet fed by the sheet feeding means;

(c) a sheet finisher having a stapling means for center-stapling a bundle of sheets having a plurality of sheets on which the images are formed by the image forming means and a folding means for folding double the bundle of sheets subjected to center-stapling;

(d) a sheet cutter for finishing the booklet by cutting edges of the bundle of sheets subjected to the folding double and center-stapling are cut by the cutting means;

wherein the sheet cutter comprises a booklet storing means having a booklet stand for storing a plurality of booklets, wherein the plurality of booklets are stacked on the booklet stand while sheet faces of the booklets are overlapped one another with a folded portion of each booklet facing upward;

(e) a movable wall member for pressing the sheet face of the booklet supported to stand upright on the booklet stand and reciprocating between a topside of the booklet stand and a booklet ejection opening; and (f) a driving means for making the movable wall member to reciprocate.

29. The image forming apparatus of claim 28, wherein the sheet finisher comprises an ascending and descending sheet ejection tray capable of ascending and descending on which sheets ejected are stacked, and wherein the sheet cutter comprises a prescribed space section between a bottom portion of the ascending and descending sheet ejection tray when reached a lowermost position thereof and an upper portion of the outer wall of a casing of the sheet cutter.

* * * * *